US011545100B2

(12) United States Patent
Yabuki

(10) Patent No.: US 11,545,100 B2
(45) Date of Patent: Jan. 3, 2023

(54) LIQUID CRYSTAL DISPLAY APPARATUS

(71) Applicant: SHARP KABUSHIKI KAISHA, Sakai (JP)

(72) Inventor: Haruhito Yabuki, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/688,210

(22) Filed: Mar. 7, 2022

(65) Prior Publication Data

US 2022/0293061 A1 Sep. 15, 2022

Related U.S. Application Data

(60) Provisional application No. 63/158,564, filed on Mar. 9, 2021.

(51) Int. Cl.
*G09G 3/36* (2006.01)

(52) U.S. Cl.
CPC ..... *G09G 3/3607* (2013.01); *G09G 3/3614* (2013.01)

(58) Field of Classification Search
CPC ..... G09G 2300/0439; G09G 2300/0819
See application file for complete search history.

(56) References Cited

U.S. PATENT DOCUMENTS 9,245,471 B2 * 1/2016 Tomizawa ..... H04N 9/68
2004/0183761 A1 * 9/2004 Miyachi ..... G09G 3/3648 345/87
2008/0278416 A1 * 11/2008 Ohta ..... G09G 3/2927 345/63
2008/0291133 A1 * 11/2008 Nam ..... G09G 3/2935 345/63
2011/0205207 A1 * 8/2011 Hosaka ..... G09G 3/3611 345/87
2013/0113847 A1 * 5/2013 Mori ..... G09G 3/3413 345/87
2013/0314450 A1 11/2013 Sohn et al.
2014/0354710 A1 * 12/2014 Jun ..... G09G 3/20 345/694
2015/0268495 A1 * 9/2015 Kizaki ..... G02F 1/133784 349/33

* cited by examiner

*Primary Examiner* — Van N Chow
(74) *Attorney, Agent, or Firm* — ScienBiziP, P.C.

(57) ABSTRACT

A display device according to an embodiment of the present invention uses, as a threshold value based on which it is determined whether to switch clip processing on or to switch the clip processing off, an activation grayscale level difference threshold value (or an activation grayscale voltage difference threshold value), a deactivation grayscale level difference threshold value (or a deactivation grayscale voltage difference threshold value), an activation pixel number threshold value, and a deactivation pixel number threshold value. The deactivation grayscale level difference threshold value (or the deactivation grayscale voltage difference threshold value) is smaller than the activation grayscale level difference threshold value (or the activation grayscale voltage difference threshold value). The deactivation pixel number threshold value is smaller than the activation pixel number threshold value. Hysteresis occurs at the on/off change of the clip processing, and as a result, the clip processing may be suppressed from being switched on or off frequently.

16 Claims, 16 Drawing Sheets

LIQUID CRYSTAL DISPLAY APPARATUS

This application claims priority under 35 USC § 119(e) to U.S. Provisional Application No. 63/158,564 filed on Mar. 9, 2021, the entire contents of which are hereby incorporated by reference.

BACKGROUND

1. Technical Field

The present invention relates to a liquid crystal display apparatus.

2. Description of the Related Art

A liquid crystal display apparatus is driven such that the polarity of a voltage applied to a liquid crystal layer in pixels (direction of the electric field generated in the liquid crystal layer) is inverted on a time period-by-time period basis in order to prevent image burn-in (e.g., frame inversion driving). In addition, in order to prevent flicker of an image, a driving method of changing the direction of the electric field on a pixel-by-pixel basis is adopted. For example, a driving method that generates a dot checker pattern or a vertical stripe pattern is known. Herein, the "dot" represents a "pixel". The "dot checker pattern" is a pattern in which voltages applied to the liquid crystal layer in pixels adjacent to each other have opposite polarities to each other. A minimum unit capable of providing color display formed of three pixels corresponding to the three primary colors (herein, referred to as a "color display pixel" is occasionally referred to as a "pixel". Herein, however, an individual pixel of each of the primary colors will be referred to as a "pixel" (dot).

With such a driving method that inverts the polarity, power consumption may occasionally be significantly increased for displaying a specific pattern (may be referred to as a "killer pattern"). An increase in the power consumption increases the amount of heat generation. Therefore, a measure against the heat generation needs to be taken for, for example, a source driving circuit (source driver IC). A conventionally used measure against the heat generation is, for example, provision of a heat dissipation sheet. A killer pattern that consumes a maximum amount of power is a pattern by which a source signal voltage has a potential that fluctuates with a maximum amplitude and a shortest period. The pixels are typically arrayed in a matrix including rows and columns. A source bus line extends in a column direction (vertical direction on the screen), and a gate bus line extends in a row direction (horizontal direction on the screen). The pixels of the three primary colors of red, green and blue are arrayed in the row direction (stripe array). Three such pixels form one color display pixel. In the case where a liquid crystal display apparatus including such a pixel array is driven by a method by which the polarity of an output voltage of a source driving circuit is kept the same during an effective display period included in one vertical period, the killer pattern consuming the maximum amount of power is a horizontal stripe pattern in which a white stripe and a black stripe appear alternately on a pixel row-by-pixel row basis (or on a two pixel rows-by-two pixel rows basis).

United States Patent Application Publication No. 2013/314450 (hereinafter, "Patent Document 1") discloses a liquid crystal display apparatus capable of suppressing a state where the source driving circuit ("data driver" in Patent Document No. 1) has excessive heat in the case where a certain display pattern is displayed. In the liquid crystal display apparatus described in Patent Document No. 1, the number of cases where the difference between the grayscale values of image data of two adjacent pixels connected with the same data line is larger than, or equal to, a first threshold value is counted. In the case where the counted number is larger than, or equal to, a second threshold value, the grayscale of the image data is converted.

SUMMARY

In the liquid crystal display apparatus described in Patent Document No. 1, the grayscale conversion is switched on or off merely by a slight change in the image data across the first threshold value and/or the second threshold value. Therefore, the grayscale conversion may possibly be switched on or off frequently. For example, the grayscale conversion is switched on or off even by white noise. In this case, the grayscale conversion rather increases the luminance change, which may result in unpleasant display.

The present invention made to solve the above-described problem has an object of providing a liquid crystal display apparatus capable of effectively decreasing the power consumption in order to suppress an increase in the temperature of components while suppressing a decrease in the display quality.

An embodiment of the present invention provides the solutions described in the following items.

[Item 1]

A liquid crystal display apparatus, comprising:

a display panel; and one display control circuit or a plurality of display control circuits receiving an input video signal and causing the display panel to display an image, wherein the display panel includes a plurality of pixels, a plurality of TFTs, a plurality of gate bus lines, a plurality of source bus lines, a plurality of gate driving circuits supplying the plurality of gate bus lines with a gate signal, and a plurality of source driving circuits supplying the plurality of source bus lines with a source signal; and each of the plurality of pixels is connected to one of the plurality of source bus lines via a TFT corresponding thereto among the plurality of TFTs, and each of the plurality of TFTs is connected to one of the plurality of gate bus lines, wherein the plurality of source driving circuits are configured to supply each of the plurality of source bus lines with a source signal that does not have a polarity thereof changed during an effective display period included in one vertical scanning period and has the polarity thereof inverted between two continuous vertical scanning periods, wherein the plurality of pixels form a plurality of pixel groups respectively corresponding to the plurality of source driving circuits, and the pixels included in each of the plurality of pixel groups are each supplied with a source signal from a source driving circuit corresponding thereto among the plurality of source driving circuits via the corresponding source bus line, wherein the one display control circuit or each of the plurality of display control circuits controls display of two or more pixel groups associated therewith among the plurality of pixel groups, wherein the one display control circuit or each of the plurality of display control circuits generates a set of output grayscale data regarding each of the associated two or more pixel groups based on input grayscale data in the input video signal, wherein the one display control circuit or each of the plurality of display control circuits includes a clip processing control circuit generating a clip processing control signal and a clip processing circuit performing clip processing in accordance with the clip processing control signal, and wherein the clip processing control circuit is configured to be capable of performing, in each one vertical scanning period, in a process in which the one display control circuit or each of the plurality of display control circuits generates the set of output grayscale data, a determination step including:

step A of finding, regarding each of the pixels belonging to each of the associated two or more pixel groups, an absolute value $|\Delta GL|$ of a difference $\Delta GL$ between a grayscale level $GL_1$ in a current horizontal scanning period $HP_1$ and a grayscale level $GL_0$ in an immediately previous horizontal scanning period $HP_0$ immediately previous to the current horizontal scanning period $HP_1$ of first input grayscale data to be input to the clip processing control circuit, with the associated two or more pixel groups being a determination unit, or with at least one pixel group among the associated two or more pixel groups being the determination unit, step B1 of comparing $|\Delta GL|$ regarding each of the pixels belonging to the determination unit and a predetermined activation grayscale level difference threshold value $\Delta GLThA$ with each other, and finding a number $NP_1$ of first pixels fulfilling $|\Delta GL| \geq \Delta GLThA$ among the pixels belonging to the determination unit, step B2 of comparing $|\Delta GL|$ regarding each of the pixels belonging to the determination unit and a predetermined deactivation grayscale level difference threshold value $\Delta GLThR$ ($<\Delta GLThA$) with each other, and finding a number $NP_2$ of second pixels fulfilling $|\Delta GL| \geq \Delta GLThR$ among the pixels belonging to the determination unit, step C1 of comparing the number $NP_1$ of the first pixels and a predetermined activation pixel number threshold value NPThA with each other, and determining whether or not $NP_1 \leq NPThA$ is fulfilled, and step C2 of comparing the number $NP_2$ of the second pixels and a predetermined deactivation pixel number threshold value NPThR (<NPThA) with each other, and determining whether or not $NP_2 \geq NPThR$ is fulfilled, and step D of generating, based on the results of steps C1 and C2, the clip processing control signal that activates the clip processing of limiting a grayscale level of the first input grayscale data to a predetermined range, deactivates the clip processing, or maintains the clip processing activated or deactivated, regarding each of the pixels belonging to each of the associated two or more pixel groups.

[Item 2]

The liquid crystal display apparatus of item 1, wherein the determination step is executed with each pixel group among the associated two or more pixel groups being the determination step, and wherein in step D, the clip processing control circuit generates the clip processing control signal that activates the clip processing in the case where the result of step C1 is true regarding at least one pixel group among the associated two or more pixel groups, maintains the clip processing activated or deactivated in the case where the result of step C1 is false regarding all the associated two or more pixel groups and the result of step C2 is true regarding at least one pixel group among the associated two or more pixel groups, and deactivates the clip processing in the case where the result of C2 is false regarding all the associated two or more pixel groups.

As described above, in an embodiment, the determination step may be performed for each source driving circuit. This is effective for displaying a pattern by which a part of the plurality of source driving circuits has a large load imposed thereon (is heated).

[Item 3]

The liquid crystal display apparatus of item 1, wherein the determination step is executed with the associated two or more pixel groups being the determination step, and wherein in step D, the clip processing control circuit generates the clip processing control signal that activates the clip processing in the case where the result of step C1 is true, maintains the clip processing activated or deactivated in the case where the result of step C1 is false and the result of step C2 is true, and deactivates the clip processing in the case where the result of C2 is false.

As described above, in an embodiment, the determination step may be performed for each display control circuit.

[Item 4]

The liquid crystal display apparatus of any one of items 1 through 3, wherein the one display control circuit or the plurality of display control circuits is one display control circuit, and wherein the associated two or more pixel groups are the plurality of pixel groups.

[Item 5]

The liquid crystal display apparatus of any one of items 1 through 3, wherein the one display control circuit or the plurality of display control circuits is the plurality of display control circuits, and wherein the clip processing control circuit in each of the plurality of display control circuits performs steps A through D regarding the two or more pixel groups associated therewith, and as a result, a plurality of the clip processing control signals are generated, and wherein the clip processing circuit in each of the plurality of display control circuits switches the clip processing to a state of being activated or to a state of being deactivated based on at least one of the plurality of clip processing control signals.

As described above, in an embodiment, the plurality of display control circuits may be included, and the determination step may be performed for each of the display control circuits. The clip processing may be performed based on the determination result of at least one display control circuit.

[Item 6]

The liquid crystal display apparatus of item 5, wherein the clip processing circuit in each of the plurality of display control circuits switches the clip processing to a state of being activated or maintains the clip processing in the state of being activated in the case where the at least one of the plurality of clip processing control signals is a signal that activates the clip processing or a signal that maintains the clip processing activated.

[Item 7]

The liquid crystal display apparatus of item 5 or 6, further comprising a signal line connecting the plurality of display control circuits to each other, wherein the plurality of display control circuits share the plurality of clip processing control signals via the signal line.

In an embodiment, the clip processing may be performed by the difference in the determination result between the plurality of display control circuits in this manner.

[Item 8]

The liquid crystal display apparatus of any one of items 1 through 7, wherein steps A, B1 and B2 are performed during the effective display period included in one vertical scanning period, and wherein steps C1, C2 and D are performed after steps B1 and B2 are finished but before the one vertical scanning period is finished.

[Item 9]

The liquid crystal display apparatus of any one of items 1 through 8, wherein the clip processing limits a lower limit and/or an upper limit of the grayscale level of the first input grayscale data.

[Item 10]

The liquid crystal display apparatus of any one of items 1 through 9, wherein for switching the clip processing to a state of being activated or to a state of being deactivated, the clip processing circuit maintains the current state of the clip processing of being activated or deactivated until a certain vertical scanning period after a current vertical scanning period is finished, and switches the clip processing to the state of being activated or to the state of being deactivated at the start of a vertical scanning period next to the certain vertical scanning period.

[Item 11]

The liquid crystal display apparatus of item 10, wherein the certain vertical scanning period is a fourth vertical scanning period after the current vertical scanning period.

[Item 12]

The liquid crystal display apparatus of any one of items 1 through 11, wherein the clip processing circuit is located on a stage after the clip processing control circuit.

[Item 13]

The liquid crystal display apparatus of any one of items 1 through 12, wherein the one display control circuit or each of the plurality of display control circuit further includes an overdrive conversion circuit, wherein the first input grayscale data is overdrive-converted by the overdrive conversion circuit, and wherein the overdrive conversion circuit does not perform overdrive conversion while the clip processing is activated, and performs the overdrive conversion while the clip processing is deactivated.

[Item 14]

The liquid crystal display apparatus of any one of items 1 through 13, wherein the one display control circuit or each of the plurality of display control circuit further includes a ghost correction circuit, wherein the ghost correction circuit performs ghost correction on the first input grayscale data, and wherein the ghost correction circuit shares a line memory with the clip processing control circuit.

[Item 15]

The liquid crystal display apparatus of any one of items 1 through 14, wherein the one display control circuit or each of the plurality of display control circuit further includes a dither conversion circuit, and wherein the set of output grayscale data is generated as a result of the first input grayscale data processed by the clip processing being dither-converted by the dither conversion circuit.

[Item 16]

A liquid crystal display apparatus, comprising:

a display panel; and one display control circuit or a plurality of display control circuits receiving an input video signal and causing the display panel to display an image, wherein the display panel includes a plurality of pixels, a plurality of TFTs, a plurality of gate bus lines, a plurality of source bus lines, a plurality of gate driving circuits supplying the plurality of gate bus lines with a gate signal, and a plurality of source driving circuits supplying the plurality of source bus lines with a source signal; and each of the plurality of pixels is connected to one of the plurality of source bus lines via a TFT corresponding thereto among the plurality of TFTs, and each of the plurality of TFTs is connected to one of the plurality of gate bus lines, wherein the plurality of source driving circuits are configured to supply each of the plurality of source bus lines with a source signal that does not have a polarity thereof changed during an effective display period included in one vertical scanning period and has the polarity thereof inverted between two continuous vertical scanning periods, wherein the plurality of pixels form a plurality of pixel groups respectively corresponding to the plurality of source driving circuits, and the pixels included in each of the plurality of pixel groups are each supplied with a source signal from a source driving circuit corresponding thereto among the plurality of source driving circuits via the corresponding source bus line, wherein the one display control circuit or each of the plurality of display control circuits controls display of two or more pixel groups associated therewith among the plurality of pixel groups, wherein the one display control circuit or each of the plurality of display control circuits generates a set of output grayscale data regarding each of the associated two or more pixel groups based on input grayscale data in the input video signal, wherein the one display control circuit or each of the plurality of display control circuits includes a clip processing control circuit generating a clip processing control signal and a clip processing circuit performing clip processing in accordance with the clip processing control signal, wherein the clip processing control circuit includes a grayscale-voltage conversion circuit converting grayscale data into grayscale voltage data, and wherein the clip processing control circuit is configured to be capable of performing, in each one vertical scanning period, in a process in which the one display control circuit or each of the plurality of display control circuits generates the set of output grayscale data, a determination step including:

step A of finding, regarding each of the pixels belonging to each of the associated two or more pixel groups, an absolute value $|\Delta VG|$ of a difference $\Delta VG$ between a grayscale voltage $VG_1$ in a current horizontal scanning period $HP_1$ and a grayscale voltage $VG_0$ in an immediately previous horizontal scanning period $HP_0$ immediately previous to the current horizontal scanning period $HP_1$ of first input grayscale voltage data converted from the first input grayscale data to be input to the clip processing control circuit, with the associated two or more pixel groups being a determination unit, or with at least one pixel group among the associated two or more pixel groups being the determination unit, step B1 of comparing $|\Delta VG|$ regarding each of the pixels belonging to the determination unit and a predetermined activation grayscale voltage difference threshold value $\Delta VGThA$ with each other, and finding a number $NP_1$ of first pixels fulfilling $|\Delta VG| \geq \Delta VGThA$ among the pixels belonging to the determination unit, step B2of comparing $|\Delta VG|$ regarding each of the pixels belonging to the determination unit and a predetermined deactivation grayscale voltage difference threshold value $\Delta VGThR$ ($<\Delta VGThA$) with each other, and finding a number $NP_2$ of second pixels fulfilling $|\Delta VG| \geq \Delta VGThR$ among the pixels belonging to the determination unit, step C1 of comparing the number $NP_1$ of the first pixels and a predetermined activation pixel number threshold value NPThA with each other, and determining whether or not $NP_1 \geq NPThA$ is fulfilled, and step C2 of comparing the number $NP_2$ of the second pixels and a predetermined deactivation pixel number threshold value NPThR (<NPThA) with each other, and determining whether or not $NP_2 \geq NPThR$ is fulfilled, and step D of generating, based on the results of steps C1 and C2, the clip processing control signal that activates the clip processing of limiting a grayscale level of the first input grayscale data to a predetermined range, deactivates the clip processing, or maintains the clip processing activated or deactivated, regarding each of the pixels belonging to each of the associated two or more pixel groups.

As described above, the grayscale data may be converted into grayscale voltage data, and the determination step may be performed based on the grayscale voltage difference instead of the grayscale level difference. Determination performed based on the grayscale voltage difference may increase the precision of detecting the display for which the clip processing is to be performed.

[Item 17]

The liquid crystal display apparatus of item 16, wherein the determination step is executed with each pixel group among the associated two or more pixel groups being the determination step, and wherein in step D, the clip processing control circuit generates the clip processing control signal that activates the clip processing in the case where the result of step C1 is true regarding at least one pixel group among the associated two or more pixel groups, maintains the clip processing activated or deactivated in the case where the result of step C1 is false regarding all the associated two or more pixel groups and the result of step C2 is true regarding at least one pixel group among the associated two or more pixel groups, and deactivates the clip processing in the case where the result of C2 is false regarding all the associated two or more pixel groups.

[Item 18]

The liquid crystal display apparatus of item 16, wherein the determination step is executed with the associated two or more pixel groups being the determination step, and wherein in step D, the clip processing control circuit generates the clip processing control signal that activates the clip processing in the case where the result of step C1 is true, maintains the clip processing activated or deactivated in the case where the result of step C1 is false and the result of step C2 is true, and deactivates the clip processing in the case where the result of C2 is false.

[Item 19]

The liquid crystal display apparatus of any one of items 16 through 18, wherein the one display control circuit or the plurality of display control circuits is one display control circuit, and wherein the associated two or more pixel groups are the plurality of pixel groups.

[Item 20]

The liquid crystal display apparatus of any one of items 16 through 18, wherein the one display control circuit or the plurality of display control circuits is the plurality of display control circuits, and wherein the clip processing control circuit in each of the plurality of display control circuits performs steps A through D regarding the two or more pixel groups associated therewith, and as a result, a plurality of the clip processing control signals are generated, and wherein the clip processing circuit in each of the plurality of display control circuits switches the clip processing to a state of being activated or to a state of being deactivated based on at least one of the plurality of clip processing control signals.

[Item 21]

The liquid crystal display apparatus of item 20, wherein the clip processing circuit in each of the plurality of display control circuits switches the clip processing to a state of being activated or maintains the clip processing in the state of being activated in the case where the at least one of the plurality of clip processing control signals is a signal that activates the clip processing or a signal that maintains the clip processing activated.

[Item 22]

The liquid crystal display apparatus of item 20 or 21, further comprising a signal line connecting the plurality of display control circuits to each other, wherein the plurality of display control circuits share the plurality of clip processing control signals via the signal line.

[Item 23]

The liquid crystal display apparatus of any one of items 16 through 22, wherein steps A, B1 and B2 are performed during the effective display period included in one vertical scanning period, and wherein steps C1, C2 and D are performed after steps B1 and B2 are finished but before the one vertical scanning period is finished.

[Item 24]

The liquid crystal display apparatus of any one of items 16 through 23, wherein the clip processing limits a lower limit and/or an upper limit of the grayscale level of the first input grayscale data.

[Item 25]

The liquid crystal display apparatus of any one of items 16 through 24, wherein for switching the clip processing to a state of being activated or to a state of being deactivated, the clip processing circuit maintains the current state of the clip processing of being activated or deactivated until a certain vertical scanning period after a current vertical scanning period is finished, and switches the clip processing to the state of being activated or to the state of being deactivated at the start of a vertical scanning period next to the certain vertical scanning period.

[Item 26]

The liquid crystal display apparatus of item 25, wherein the certain vertical scanning period is a fourth vertical scanning period after the current vertical scanning period.

[Item 27]

The liquid crystal display apparatus of any one of items 16 through 26, wherein the clip processing circuit is located on a stage after the clip processing control circuit.

[Item 28]

The liquid crystal display apparatus of any one of items 16 through 27, wherein the one display control circuit or each of the plurality of display control circuit further includes an overdrive conversion circuit, wherein the first input grayscale data is overdrive-converted by the overdrive conversion circuit, and wherein the overdrive conversion circuit does not perform overdrive conversion while the clip processing is activated, and performs the overdrive conversion while the clip processing is deactivated.

[Item 29]

The liquid crystal display apparatus of any one of items 16 through 28, wherein the one display control circuit or each of the plurality of display control circuit further includes a ghost correction circuit, wherein the ghost correction circuit performs ghost correction on the first input grayscale data, and wherein the ghost correction circuit shares a line memory with the clip processing control circuit.

[Item 30]

The liquid crystal display apparatus of any one of items 16 through 29, wherein the one display control circuit or each of the plurality of display control circuit further includes a dither conversion circuit, and wherein the set of output grayscale data is generated as a result of the first input grayscale data processed by the clip processing being dither-converted by the dither conversion circuit.

An embodiment of the present invention provides a liquid crystal display apparatus capable of effectively decreasing the power consumption in order to suppress an increase in the temperature of components while suppressing a decrease in the display quality, and a method for driving the same. According to an embodiment of the present invention, for example, there is no need to take a measure against heat generation such as, for example, provision of a heat dissipation sheet. Therefore, an increase in the cost of the liquid crystal display apparatus may be suppressed.

DETAILED DESCRIPTION

Hereinafter, a liquid crystal display apparatus and a method for driving the same according to an embodiment of the present invention will be described with reference to the drawings. A liquid crystal display apparatus according to an embodiment of the present invention is used especially preferably as a liquid crystal display apparatus consuming a large amount of power, for example, a liquid crystal display apparatus that is of a large scale, of a high definition or of a high operating frequency. However, the liquid crystal display apparatus according to an embodiment of the present invention is not limited to those described below as examples. In the figures referred to below, components having substantially the same functions will bear the same reference signs, and the descriptions thereof may be omitted for the sake of simplicity.

Figure 1:
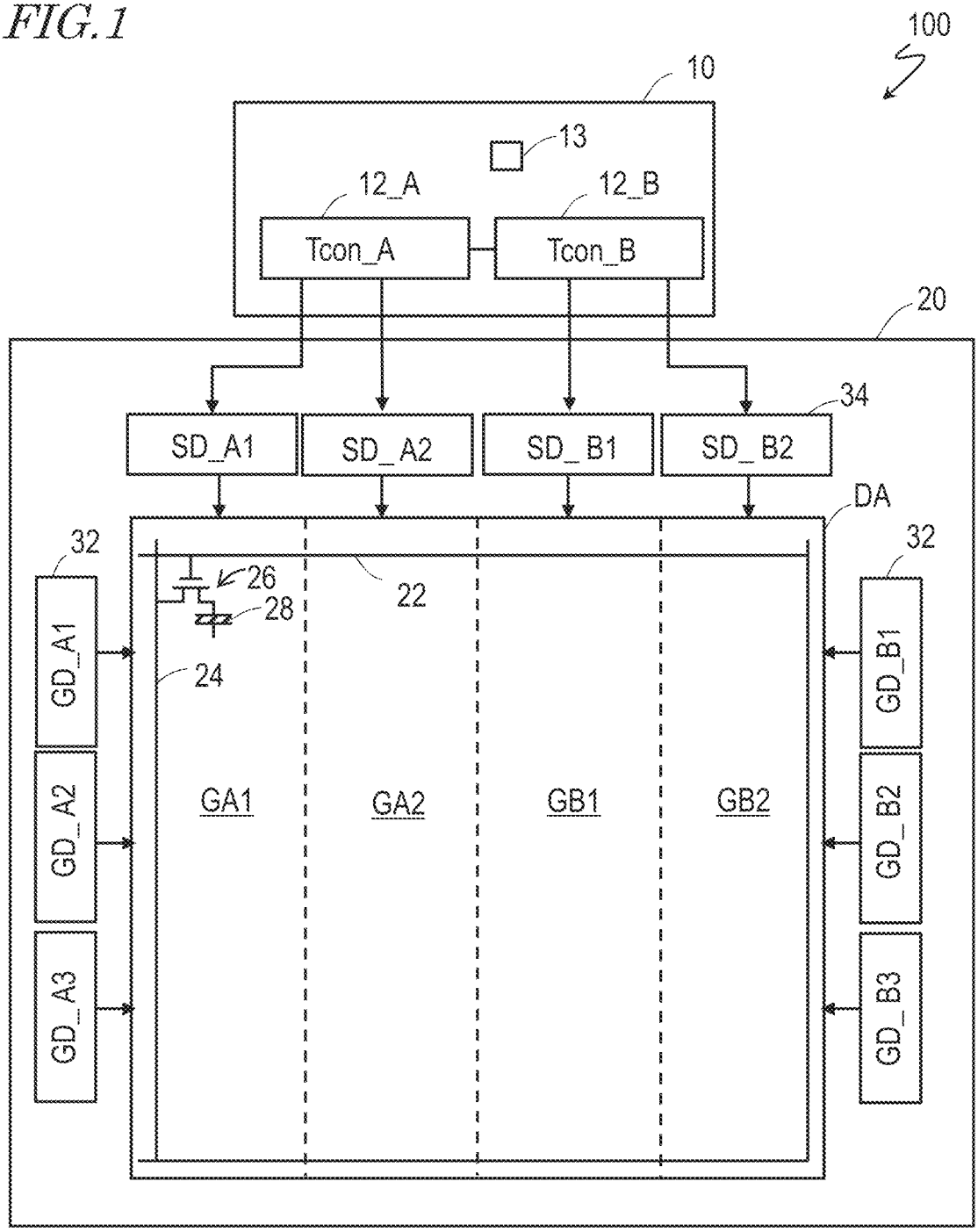
FIG. 1 is a schematic view showing a configuration of a liquid crystal display apparatus 100 according to an embodiment of the present invention.

FIG. 1 schematically shows an example of configuration of a liquid crystal display apparatus 100 according to an embodiment of the present invention. The liquid crystal display apparatus 100 includes a liquid crystal display panel (hereinafter, referred to as a "display panel") 20 and a control circuit 10. The control circuit 10 receives an input video signal and a single power supply voltage. The control circuit 10 incudes two display control circuits 12_A (Tcon_A) and 12_B(Tcon_B) receiving the input video signal and causing the display panel 20 to display an image, and a power supply control circuit 13. Generally, a display control circuit includes a timing controller (Tcon). A liquid crystal display apparatus used in a general liquid crystal TV includes one display control circuit, but a liquid crystal display apparatus including two or more display control circuits like the liquid crystal display apparatus 100 is also known. For example, a known liquid crystal display apparatus for an 8K (e.g., 7680×4320) liquid crystal TV driven at 60 Hz includes one display control circuit, and a known liquid crystal display apparatus for an 8K liquid crystal TV driven at 120 Hz includes two display control circuits. A liquid crystal display apparatus includes at least one display control circuit. The power supply control circuit 13 generally includes a power IC, and converts the single power supply voltage into a plurality of power supply voltages to be used in the liquid crystal display apparatus 100.

The display panel 20 includes a plurality of gate bus lines 22, a plurality of source bus lines 24, a plurality of TFTs 26, a plurality of pixels 28, a plurality of gate driving circuits 32 supplying the plurality of gate bus lines with a gate signal, and a plurality of source driving circuits 34 supplying the plurality of source bus lines 24 with a source signal. Hereinafter, the gate driving circuits 32 may be referred to as "gate drivers (GD) 32", and the source driving circuits 34 may be referred to as "source drivers (SD) 34". Herein, six gate drivers including three gate drivers GD_A1, GD_A2 and GD_A3 located to the left of the display panel 20 in a horizontal direction and three gate drivers GD_B1, GD_B2 and GD_B3 located to the right of the display panel 20 in the horizontal direction, and four source drivers SD_A1, SD_A2, SD_B1 and SD_B2 are shown. The numbers and the locations of the gate drivers 32 and the source drivers 34 are not limited to the above.

The pixels 28 are represented as liquid crystal capacitances 28 in an electric circuit. The liquid crystal capacitances 28 may occasionally be connected with storage capacitances (accumulation capacitances) (not shown) in an electrically parallel manner. The liquid crystal capacitances 28 and the storage capacitances may collectively be referred to "pixel capacitances 28". As shown herein, the gate drivers 32 and/or the source drivers 34 may be formed monolithically on a TFT substrate included in the display panel 20, more specifically, in a region around a display region DA, in which the plurality of pixels 28 are arrayed. Alternatively, the gate drivers 32 and/or the source drivers 34 may be mounted on the TFT substrate as an IC. Still alternatively, another substrate having the gate drivers 32 and/or the source drivers 34 mounted thereon (e.g., a flexible substrate) may be mounted on the TFT substrate.

Herein, the plurality of pixels 28 are arrayed in a matrix including rows and columns in a typical example. The gate bus lines 22 extend in a row direction (horizontal direction on a display plane), and the source bus lines 24 extend in a column direction (vertical direction on the display plane).

The plurality of pixels 28 are each connected with one of the plurality of source bus lines 24 via one TFT 26 corresponding thereto among the plurality of TFTs 26, and the plurality of TFTs 26 are each connected with one of the plurality of gate bus lines 22. The plurality of pixels 28 form a plurality of pixel groups respectively corresponding to the plurality of source drivers 34. In the example shown in FIG. 1, a pixel group GA1 corresponds to the source driver SD_A1, a pixel group GA2 corresponds to the source driver SD_A2, a pixel group GB1 corresponds to the source driver SD_B1, and a pixel group GB2 corresponds to the source driver SD_B2. The pixels 28 belonging to each of the plurality of pixel groups are each supplied with a source signal from a source driver 34 corresponding thereto among the plurality of source drivers 34 via the corresponding source bus line 24.

The display control circuits 12_A and 12_B each control display of two or more pixel groups associated therewith among the plurality of pixel groups. Namely, one display control circuit 12_A or 12_B controls two or more of the source drivers 34. In the example shown in FIG. 1, the display control circuit 12_A controls the display of the pixel group GA1 corresponding to the source driver SD_A1 and the pixel group GA2 corresponding to the source driver SD_A2. The display control circuit 12_B controls the display of the pixel group GB1 corresponding to the source driver SD_B1 and the pixel group GB2 corresponding to the source driver SD_B2. Namely, the display control circuits 12_A and 12_B each generate a set of output grayscale data regarding each of the two or more pixel groups associated therewith, based on input grayscale data in the input video signal, and transmit the generated set of output grayscale data to the display panel 20. Specifically, the display control circuits 12_A and 12_B each transmit the set of output grayscale data to the source drivers 34 respectively corresponding to the pixel groups.

Now, in a liquid crystal display apparatus according to an embodiment of the present invention, each of the source signals does not have a polarity thereof changed during an effective display period included in one vertical scanning period, and has the polarity thereof inverted between two continuous vertical scanning periods.

A voltage to be applied to a liquid crystal layer in a certain pixel 28 is a voltage between a pixel electrode and a common electrode. The pixel electrode is supplied with a source signal (display signal) from the source bus line 24 via the TFT 26. The source signal includes a source signal voltage to be supplied to the plurality of pixel electrodes connected to the source bus line 24 via the corresponding TFTs 26. The source signal voltage is changed along time. A source signal voltage (display voltage) to be supplied to a certain pixel electrode is a voltage of the source signal during a time period in which the TFT 26 connected with the pixel electrode is in an ON state by a gate signal. A source signal voltage on the basis of the voltage to be applied to the common electrode (hereinafter, such a voltage will be referred to as a "common voltage") is applied to the liquid crystal layer in the pixel 28. Hereinafter, unless otherwise specified, a potential of the source signal (or the source signal voltage) will be on the basis of the common voltage. Therefore, the source signal voltage to be applied to the pixel electrode via the TFT is equal to the voltage to be applied to the liquid crystal layer in the pixel.

The polarity of the source signal is inverted on a vertical scanning period-by-vertical scanning period basis. In each vertical scanning period, a difference (time period) between the time at which a certain gate bus line is selected and the time at which the next gate bus line is selected is referred to as "one horizontal scanning period (1H)". One vertical scanning period (1V) is a sum of the effective display period Vdisp (1H×number of pixel rows/n; n=1 in the case of a single source configuration, and n=2 in the case of a double source configuration) and a vertical blanking period (Vblank). In a liquid crystal display apparatus, one frame period refers to the one vertical scanning period (1V) mentioned above.

Figure 2:
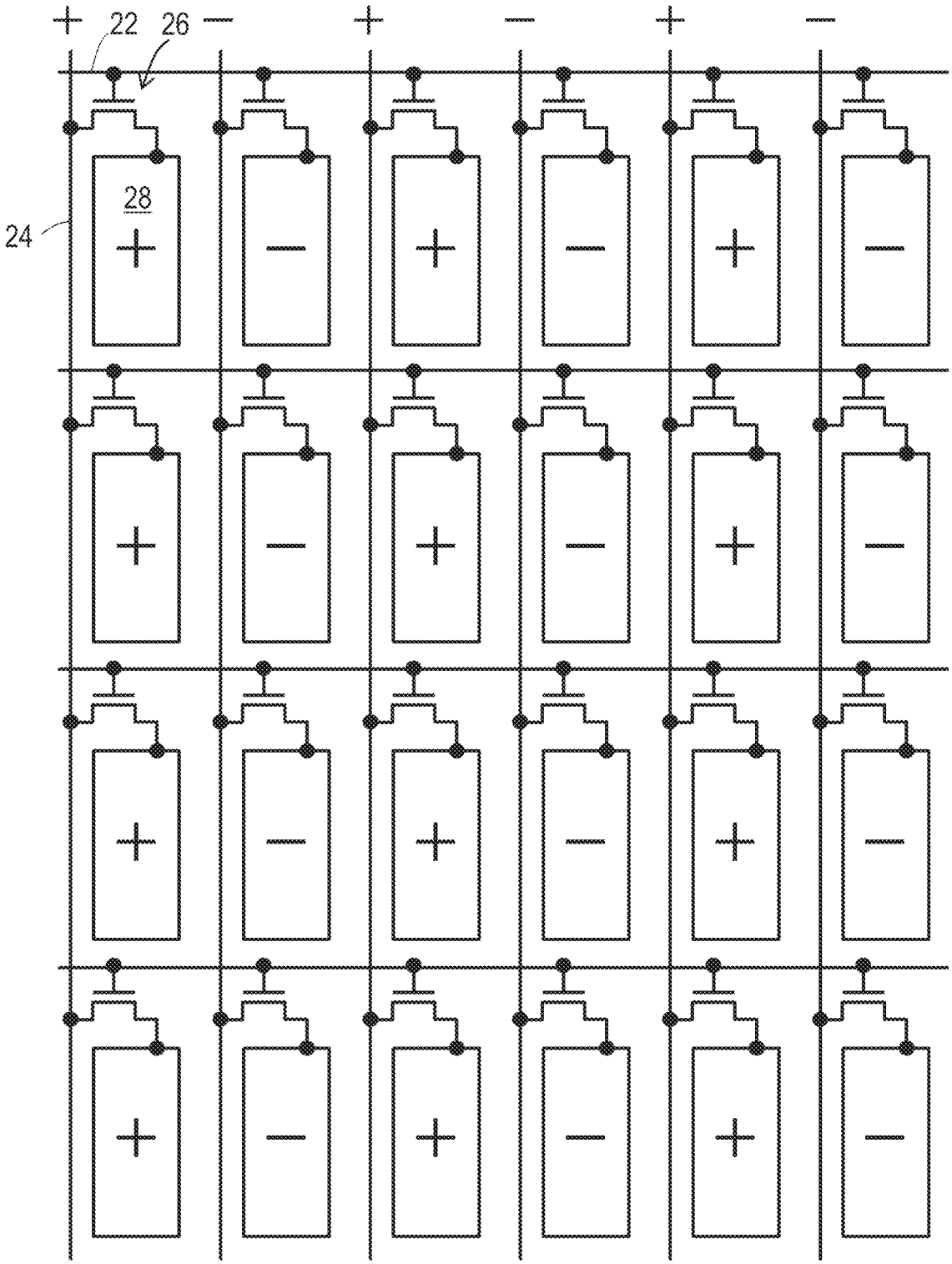
FIG. 2 is a schematic view showing a distribution of polarities of pixels, in a certain vertical scanning period (frame period), formed by source line inversion driving performed on a liquid crystal display apparatus having a single-source configuration.
Figure 3:
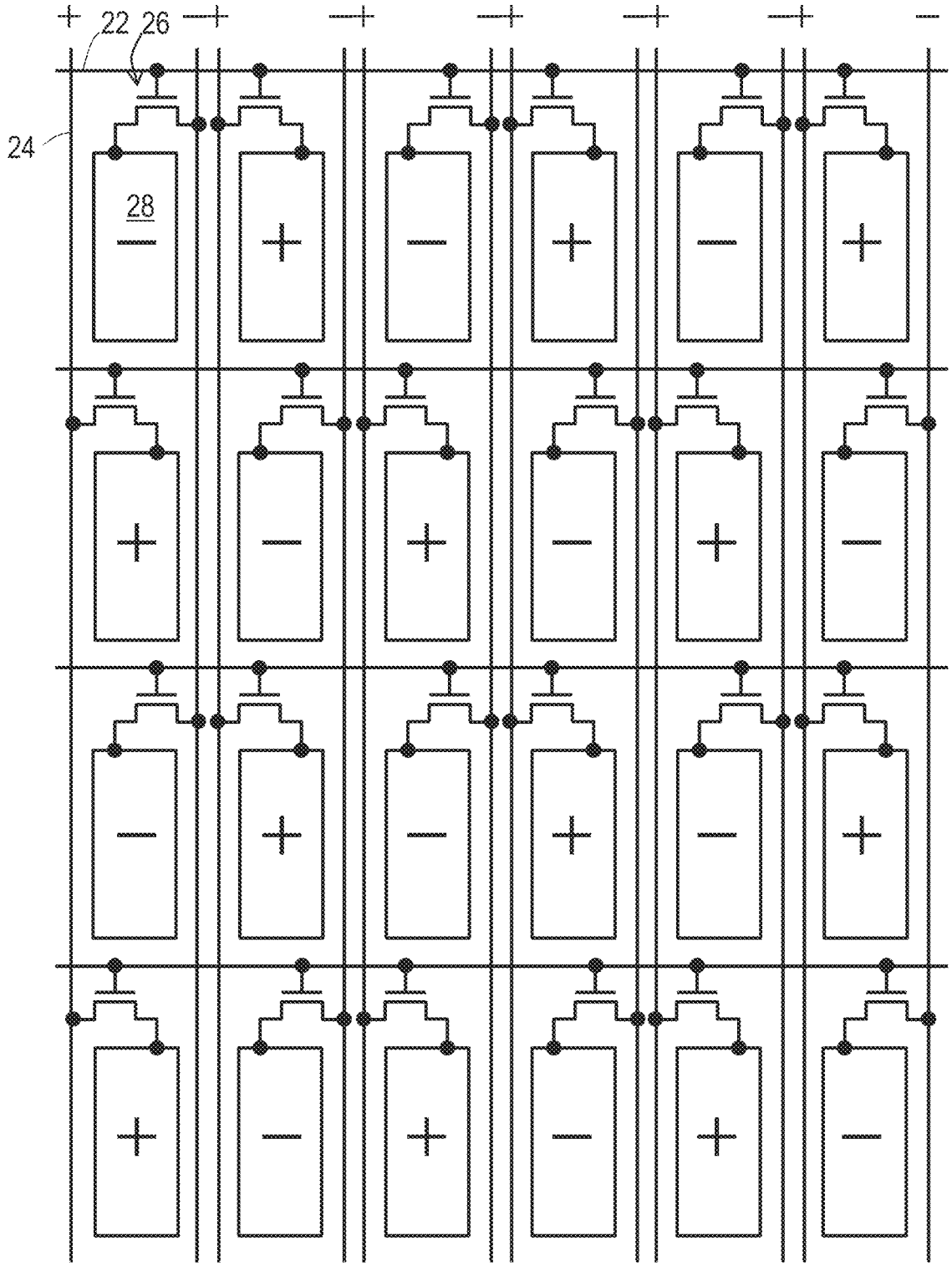
FIG. 3 is a schematic view showing a distribution of polarities of pixels, in a certain vertical scanning period (frame period), formed by source line inversion driving performed on a liquid crystal display apparatus having a double-source configuration.

As described above, in a liquid crystal display apparatus according to an embodiment of the present invention, each of the source signals does not have the polarity thereof changed during the effective display period included in one vertical scanning period, and has the polarity thereof inverted between two continuous vertical scanning periods. Specifically, for example, as shown in FIG. 2, the source line inversion driving may be performed with the single source configuration. Alternatively, as shown in FIG. 3, the source line inversion driving may be performed with the double source configuration. In this specification, the "source line inversion driving" refers to "driving by which source signals adjacent to each other have inverted polarities to each other in one vertical scanning period, and each of the source signals does not have the polarity thereof changed during the effective display period included in one vertical scanning period".

The "single source configuration" shown in FIG. 2 refers to a configuration in which one pixel column is supplied with source signals from one source bus line 24. The "double source configuration" shown in FIG. 3 refers to a configuration in which one pixel column is supplied with source signals from two source bus lines 24. In the double source configuration, the pixels included in one pixel column are connected to different source bus lines 24 alternately among the two source bus lines 24, and the two source bus lines 24 supply source signals of different polarities from each other. FIG. 2 and FIG. 3 each schematically show a spatial array of the polarities of the pixels in one vertical scanning direction (one frame period). In FIG. 2, the polarities of the pixels form a vertical stripe pattern (the polarity is inverted on a pixel column-by-pixel column basis). In FIG. 3, the polarities of the pixels form a dot checker pattern.

In such a liquid crystal display apparatus, a killer pattern consuming a maximum amount of power in the case of the single source configuration is a horizontal stripe pattern in which black and white appear alternately on a pixel row-by-pixel row basis. The killer pattern in the case of the double source configuration is a horizontal stripe pattern in which black and white appear alternately on a two pixel rows-by-two pixel rows basis. Herein, "white" represents the highest grayscale level (e.g., grayscale level 1023/1023 grayscale), and "black" represents the lowest grayscale level (e.g., grayscale level 0/1023 grayscale).

The liquid crystal display apparatus 100 according to an embodiment of the present invention performs clipping as described below, and therefore, may effectively decrease the power consumption while suppressing a decrease in the display quality. Hereinafter, a liquid crystal display apparatus and a method for driving the same according to an embodiment of the present invention will be described more specifically. Needless to say, the liquid crystal display apparatus according to an embodiment of the present invention is not limited to the following example in any way.

Figure 4:
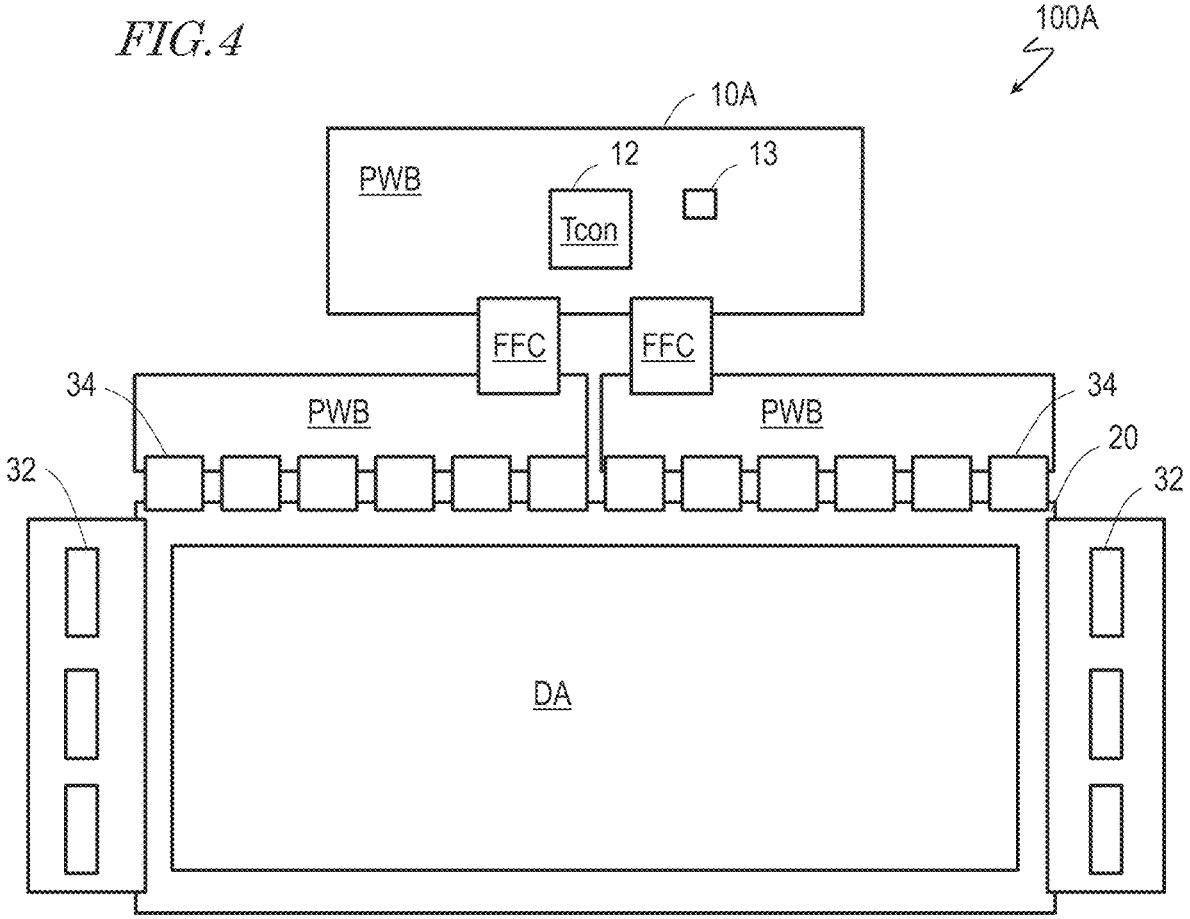
FIG. 4 is a schematic view showing a configuration of a liquid crystal display apparatus 100A, according to a first embodiment of the present invention.

FIG. 4 schematically shows a configuration of a liquid crystal display apparatus 100A according to an embodiment of the present invention. A control circuit 10A included in the liquid crystal display apparatus 100A includes one display control circuit 12 and the power supply control circuit 13. The control circuit 10A receives an input video signal and a single power supply voltage. The display control circuit 12 receives the input video signal and causes the display panel 20 to display an image. The display control circuit 12 receives a clock and an input synchronization signal (e.g., Data Enable) together with the input video signal, generates a synchronization signal for internal processing, generates a driver control signal based on the synchronization signal to control the operation of the gate drivers 32 and the source drivers 34, and supplies the source drivers 34 with a set of output grayscale data. The power supply control circuit 13 converts the single power supply voltage into a plurality of power supply voltages to be used in the liquid crystal display apparatus 100A. The source drivers 34 each convert a digital signal into an analog signal based on the set of output grayscale data, and each output a source signal (display signal).

The display control circuit 12 supplies, for example, 12 source drivers 34 and six gate drivers 32 with a control signal. Among the 12 source drivers 34, a group of six source drivers 34 are mounted on a printed wiring board (PWB), and another group of six source drivers 34 are mounted on another PWB. The two groups of source drivers 34 are each connected with the display control circuit 12 via a flexible flat cable (FFC). The display control circuit 12 is also connected with the six gate drivers 32 via the FFCs and/or the PWBs.

The display control circuit 12 is generally a system LSI called a timing controller (Tcon), and components thereof are represented by functional blocks. The functional blocks may be realized by, for example, hardware (a logic circuit and a circuit including a memory) of a system LSI, mounted software (program), or a combination of hardware and software. A clip processing control circuit and a clip processing circuit included in the display control circuit 12 each refer to a functional block, and are each realized by hardware, software, or a combination of hardware and software to execute clip processing control or clip processing. The display control circuit 12 may have a configuration including a conventional timing controller and the above-mentioned functional blocks (the clip processing control circuit and the clip processing circuit). Functional blocks included in the display control circuit 12 other than the clip processing control circuit and the clip processing circuit may be the same as the functional blocks included in a display control circuit of any of various known liquid crystal display apparatuses (e.g., liquid crystal display apparatus for a liquid crystal TV). The circuits and the programs realizing such functional blocks are well known to a person of ordinary skill in the art, and therefore, descriptions thereof may be omitted for the sake of simplicity.

Figure 5:
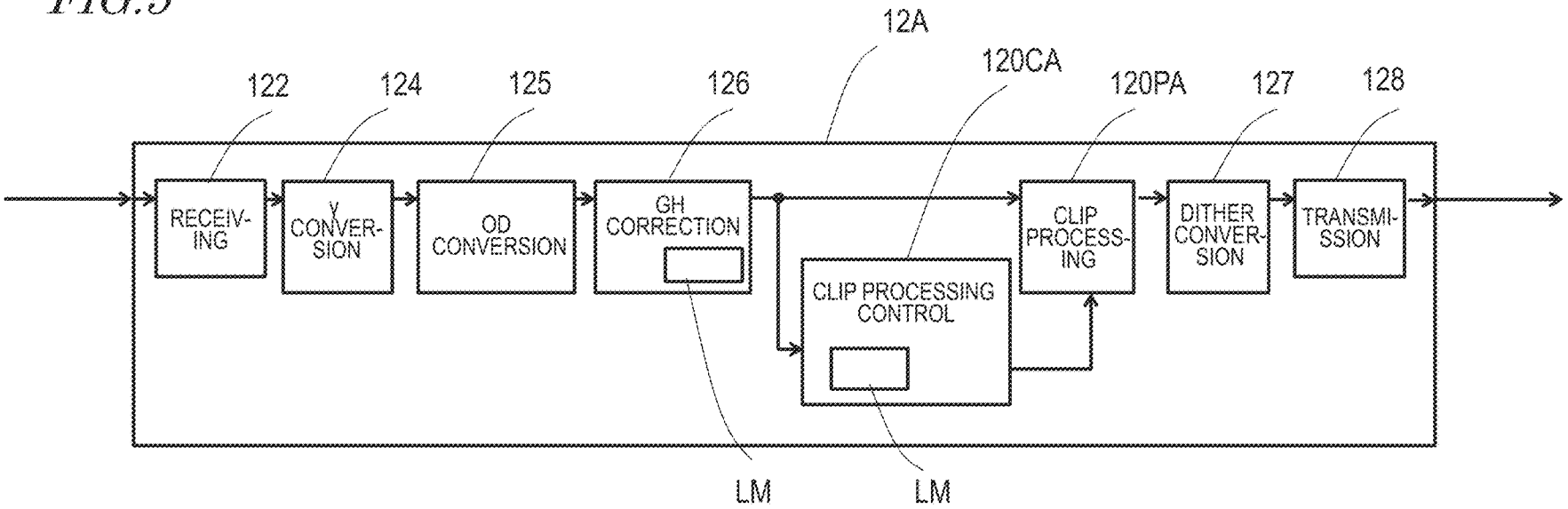
FIG. 5 is a schematic block diagram of a display control circuit 12A included in the liquid crystal display apparatus 100A, according to the first embodiment of the present invention.

The display control circuit 12 included in the liquid crystal display apparatus 100A according to a first embodiment of the present invention may be, for example, a display control circuit 12A shown in FIG. 5. FIG. 5 is a schematic block diagram of the display control circuit 12A. Herein, an example in which each of the blocks is a circuit will be described. Unlike the conventional display control circuit, the display control circuit 12A includes a clip processing control circuit 120CA and a clip processing circuit 120PA.

The display control circuit 12A includes, for example, a receiving circuit 122, a γ conversion circuit 124, an overdrive conversion (OD conversion) circuit 125, a ghost correction (GH correction) circuit 126, the clip processing control circuit 120CA, the clip processing circuit 120PA, a dither conversion circuit 127, and a transmission circuit 128.

The GH correction circuit 126 and the clip processing control circuit 120CA each include a line memory LM, and are each configured to be capable of reading data in a current horizontal scanning period ($HP_1$) and data in an immediately previous horizontal scanning period ($HP_0$) immediately previous thereto at the same time.

The receiving circuit 122 receives, for example, an input video signal (and a synchronization signal, etc.). The γ conversion circuit 124 converts input grayscale data included in the input video signal into grayscale data corresponding to a γ characteristic (grayscale-luminance characteristic) of the display panel. The γ conversion circuit 124 includes, for example, a look-up table (LUT), and uses the LUT to perform the γ conversion. At this point, the number of bits of the input and the number of bits of the output may be equal to each other, or the number of bits of the output may be larger than the number of bits of the input. For example, the input may be of 10 bits whereas the output may be of 12 bits. The γ conversion may be performed independently for each of the primary color pixels (e.g., an R pixel, a G pixel and a B pixel). Namely, the γ conversion circuit 124 may include, for example, an LUT for the R pixel, an LUT for the G pixel, and an LUT for the B pixel.

The OD conversion circuit 125 converts the input grayscale data in order to improve a response characteristic of the display panel. On a stage before being input to the OD conversion circuit 125, the input grayscale data is converted by the γ conversion circuit 124. For the sake of simplicity, the input grayscale data processed by the conversion or the like before being input to the OD conversion circuit 125 may be referred to simply as "input grayscale data". This will also apply to the following.

In the case where, for example, the grayscale level to be displayed in a current vertical scanning period is higher than the grayscale level displayed in an immediately previous vertical scanning period immediately previous thereto, the OD conversion circuit 125 converts the input grayscale data into grayscale data corresponding to the grayscale level higher than the grayscale level to be displayed in the current vertical scanning period. The OD conversion circuit 125 includes, for example, a frame memory and an LUT, and uses the LUT to perform the OD conversion. The frame memory is configured to be capable of reading the data in the immediately previous vertical scanning period at the same time when the data in the current vertical scanning period is input. The OD conversion circuit 125 performs the OD conversion based on the data in the immediately previous vertical scanning period and the data in the current vertical scanning period. The number of bits of the input to, and the number of bits of the output from, the LUT may be equal to each other, or the number of bits of the output may be larger than the number of bits of the input. The LUT does not need to include values corresponding to all the grayscale levels. For example, the LUT may have values corresponding to every 256th grayscale level for the grayscale level (input) in the immediately previous vertical scanning period. In the case where the input value is not included in the LUT, the output value may be found by, for example, two-dimensional linear interpolation. The LUT may be common to the primary color pixels (e.g., an R pixel, a G pixel and a B pixel) or independent for each of the primary color pixels.

The GH correction circuit 126 converts the input grayscale data in order to compensate for insufficient charge of the pixel capacitances. The insufficient charge of the pixel capacitances is likely to occur when a large-scale and/or high-definition liquid crystal display apparatus is driven or when the driving is performed at a high vertical scanning frequency (e.g., 120 Hz). The GH correction is effective for a case where each of the source signals does not have the polarity thereof changed during the effective display period included in one vertical scanning period. In the case where the grayscale level to be displayed in the current horizontal scanning period is higher than the grayscale level displayed in the immediately previous horizontal scanning period, the GH correction circuit 126 converts the input grayscale data into grayscale data corresponding to the grayscale level higher than the grayscale level to be displayed in the current horizontal scanning period. The GH conversion circuit 126 includes, for example, a line memory LM and an LUT, and uses the LUT to perform the GH conversion. The line memory LM is configured to be capable of reading the data in the immediately previous horizontal scanning period at the same time when the data in the current horizontal scanning period is input. The GH conversion circuit 126 performs the GH conversion based on the data in the immediately previous horizontal scanning period and the data in the current horizontal scanning period. The LUT does not need to include values corresponding to all the grayscale levels. For example, the LUT may have values corresponding to every 256th grayscale level for the grayscale level (input) in the immediately previous horizontal scanning period. In the case where the input value is not included in the LUT, the output value may be found by, for example, two-dimensional linear interpolation. The LUT may be common to the primary color pixels (e.g., an R pixel, a G pixel and a B pixel) or independent for each of the primary color pixels.

The degree of easiness at which the pixel capacitance is charged (chargeability: the value that represents to which percent the pixel capacitance is charged with respect to the target under certain conditions (e.g., under the usual driving conditions)) varies in accordance with the position of the pixel in the display region. Thus, the display region may be divided into a plurality of sub regions, and an LUT may be provided for each of the sub regions and/or the value of the LUT may be multiplied by a coefficient in accordance with the position of the sub region. Regarding the region other than the sub regions, the output value may be found by, for example, two-dimensional linear interpolation.

The dither conversion circuit 127 performs dither conversion, by which the number of bits of the data in the display control circuit 12A is decreased to the number of bits for the source drivers 34. The number of bits of the data in the display control circuit 12A is, for example, 10 or 12. By contrast, the number of bits of the data to be input to the source drivers 34 is often 8 or 10 in order to decrease the cost. Thus, the number of bits of the data in the display control circuit 12A is decreased in such a manner that information provided by the number of bits of the data in the display control circuit 12A is prevented, to a maximum possible degree, from being spoiled in the display panel including the source drivers 34, to which data having such a small number of bits is input.

For example, the dither conversion from 12 bits to 10 bits is performed as follows.

First, the upper 10 bits among the 12 bits are removed. This merely results in the lower 2 bits being rounded down. Thus, 1 is added to parts of the 10 bits, whereas 1 is not added to the other parts of the 10 bits, so that 0/4, 1/4, 2/4 and 3/4 are represented.

It is determined whether or not to add 1 based on the position of display, the lower 2 bits, and the vertical scanning period (frame). A "dither pattern" shows to which part of the image, displayed in which vertical scanning period, 1 is to be added, and also shows to which part of the image, displayed in which vertical scanning period, 1 is not to be added. This pattern is located repeatedly with a minimum unit of vertical×horizontal×frame=4×4×4.

The parts to which 1 is to be added are dispersed in accordance with the position of display. With such an arrangement, as long as an area having at least a certain area size of the input data is of the same grayscale level, the average grayscale level of the post-processing data may represent 12 bits. In addition, the parts to which 1 is to be added are dispersed timewise on a vertical scanning period-by-vertical scanning period basis. With such an arrangement, the pattern to be dispersed and the display pattern may be prevented, to a maximum possible degree, from interfering with each other. In this manner, a representation capability of almost 12 bits may be provided visually.

Now, configurations and operations of the clip processing control circuit 120CA and the clip processing circuit 120PA will be described.

The clip processing control circuit 120CA generates a clip processing control signal and outputs the generated clip processing control signal to the clip processing circuit 120PA. The clip processing circuit 120PA executes the clip processing in accordance with the clip processing control signal received from the clip processing control circuit 120CA.

In a process in which the display control circuit 12A generates a set of output grayscale data, the clip processing control circuit 120CA performs the following operation in each one vertical scanning period.

The clip processing control circuit 120CA first performs a determination step including the following steps (step A, step B1, step B2, step C1 and step C2). In the determination step, it is determined whether or not each of conditions for determining the clip processing control signal to be output to the clip processing circuit 120PA is fulfilled.

Regarding each of the pixels belonging to each of the two or more pixel groups associated with the display control circuit 12A, the following is found. First input grayscale data to be input to the clip processing control circuit 120CA has a grayscale level $GL_1$ in the current horizontal scanning period $HP_1$, and has a grayscale level $GL_0$ in the immediately previous horizontal scanning period $HP_0$ immediately previous to the current horizontal scanning period $HP_1$. For example, if the grayscale level $GL_1$ of the current horizontal scanning period $HP_1$ is the grayscale level of the target pixel, the grayscale level $GL_0$ of the previous horizontal scanning period $HP_0$ is the grayscale level of the pixel connected to the same source bus line as the target pixel and selected just before the target pixel. The pixel connected to the same source bus line as the target pixel and selected just before the target pixel is typically the pixel in one line before the target pixel in the case shown in FIG. 2, and typically the pixel in two lines before the target pixel in the case shown in FIG. 3. The grayscale level $GL_1$ and the grayscale level $GL_0$ have a difference (subtraction result) of $\Delta GL$. An absolute value $|\Delta GL|$ of the difference $\Delta GL$ is found (step A).

In this specification, the "first input grayscale data" refers to grayscale data to be input to a clip processing control circuit. The input grayscale data in the input video signal to be input to a display control circuit may be, for example, a result of the γ conversion, the OD conversion and the GH correction as described above as an example. The first input grayscale data to be input to the clip processing control circuit may be the input grayscale data itself, but is generally a result of at least one of the conversions and/or the correction described above. For example, the GH correction may be performed on the first input grayscale data to be input to the clip processing control circuit.

The two or more pixel groups associated as described above, or at least one pixel group among the two or more pixel groups associated as described above, is used as a determination unit. $|\Delta GL|$ regarding each of the pixels belonging to the determination result, and a predetermined activation grayscale level difference threshold value $\Delta GLThA$, are compared with each other; and a number $NP_1$ of first pixels fulfilling $|\Delta GL|$ $\Delta GLThA$ among the pixels belonging to the determination unit is found (step B1).

$|\Delta GL|$ regarding each of the pixels belonging to the determination result, and a predetermined deactivation (or release) grayscale level difference threshold value $\Delta GLThR$ ($<\Delta GLThA$), are compared with each other; and a number $NP_2$ of second pixels fulfilling $|\Delta GL| \geq \Delta GLThR$ among the pixels belonging to the determination unit is found (step B2).

The number $NP_1$ of the first pixels and a predetermined activation pixel number (number of pixels) threshold value NPThA are compared with each other, and it is determined whether or not $NP_1 \geq NPThA$ is fulfilled (step C1).

The number $NP_2$ of the second pixels and a predetermined deactivation pixel number threshold value NPThR ($<$NPThA) are compared with each other, and it is determined whether or not $NP_2 \geq NPThR$ is fulfilled (step C2).

Next, the clip processing control circuit 120CA generates a clip processing control signal in accordance with the result of the determination step (step D).

Based on the results of step C1 and step C2, the clip processing control circuit 120CA generates the clip processing control signal that activates the clip processing of limiting the grayscale level of the first input grayscale data to a predetermined range, deactivates the clip processing, or maintains the clip processing activated or deactivated, regarding each of the pixels belonging to each of the two or more pixel groups associated as described above (step D).

In order to perform real-time computation on a clock-by-clock basis, it is preferred that step A, step B1 and step B2are performed by a logic circuit (e.g., ASIC: Application Specific Integrated Circuit and/or FPGA: Field Programmable Gate Array, etc.) designed at RTL (Register Transfer Level), instead of by a processor. Step C1, step C2 and step D may be performed by a processor, or alternatively, may be performed by ASIC and/or FPGA, etc. like step A, step B1 and step B2. The logic circuit designed at RTL basically executes parallel processing. Therefore, step C2 may constantly be performed regardless of the result of step C1.

In accordance with the clip processing control signal, the clip processing circuit 120PA performs the clip processing of limiting the grayscale level of the first input grayscale data to a predetermined range.

As described above, in the liquid crystal display apparatus described in Patent Document No. 1, the grayscale conversion is switched on or off merely by a slight change in the image data across the first threshold value and/or the second threshold value. Therefore, the grayscale conversion may possibly be switched on or off frequently. For example, the grayscale conversion is switched on or off even by white noise. In this case, the grayscale conversion rather increases the luminance change, which may result in unpleasant display.

Activation of the clip processing decreases the display quality. For example, in the case where the clip processing is activated only on the high grayscale side, the highest luminance (white) is suppressed in the display. In the case where the clip processing is activated only on the low grayscale side, the lowest luminance (black) is unnecessarily brightened in the display. To which grayscale level the display is to be clipped on the high grayscale side and/or the low grayscale side may be determined in consideration of such a trade-off. On the low grayscale side, the display is clipped at, for example, grayscale level 32 (1024 grayscales; grayscale levels 0 to 1023), which is the inflection point of the grayscale-voltage curve. At this point, the grayscale levels lower than, or equal to grayscale level 32 are all converted into grayscale level 32, and no grayscale levels above grayscale level 32 is converted.

Such clip processing may be designed to be activated only when the killer pattern, which does not appear in the usual display, is to be displayed. With such an arrangement, the clip processing does not cause any problem to the liquid crystal display apparatus as a commercial product. A reason for this is that the possibility that the clip processing is activated is low, and even if the clip processing is activated, the decrease in the display quality caused by the clip processing is merely a decrease in white luminance and/or unnecessary brightening of black, which is not serious. By contrast, in the case where the clip processing is switched on or off frequently, the decrease in the display quality is serious and may cause a problem to the liquid crystal display apparatus as a commercial product even if the possibility that such a decrease is caused is low.

In a liquid crystal display apparatus according to an embodiment of the present invention, the activation grayscale level difference threshold value ΔGLThA, the deactivation grayscale level difference threshold value ΔGLThR (<ΔGLThA), the activation pixel number threshold value NPThA and the deactivation pixel number threshold value NPThR (<NPThA) are used as the threshold value for determining whether to switch the clip processing on or to switch the clip processing off. Therefore, hysteresis occurs at the on/off change of the clip processing, and as a result, the clip processing may be suppressed from being switched on or off frequently. This is a difference from the technology of Patent Document No. 1, according to which the grayscale conversion is switched on or off merely based on the first threshold value (grayscale level difference threshold value) and the second threshold value (pixel number threshold value).

In a liquid crystal display apparatus according to an embodiment of the present invention, the threshold values are each determined as follows, for example.

First, the activation grayscale level difference threshold value ΔGLThA is determined. The activation grayscale level difference threshold value ΔGLThA is determined based on a target value to which the power consumption is to be decreased. For example, for a liquid crystal display apparatus including a heat dissipation sheet as a measure against heat generation, it is estimated to which level the maximum power consumption needs to be decreased in order to make the heat dissipation sheet unnecessary. The activation grayscale level difference threshold value ΔGLThA is determined based on the estimated level.

Next, the deactivation grayscale level difference threshold value ΔGLThR is determined. In order to cause a sufficient level of hysteresis, the difference between the activation grayscale level difference threshold value ΔGLThA and the deactivation grayscale level difference threshold value ΔGLThR is set to, for example, at least about 10% of the difference between the maximum grayscale level and the minimum grayscale level (e.g., in the case where the maximum grayscale level is 1023 and the minimum grayscale level is 0, the difference is set to at least 102 grayscale levels). In the case where the difference between the activation grayscale level difference threshold value ΔGLThA and the deactivation grayscale level difference threshold value ΔGLThR is too small, an inconvenience may occur that the clip processing is frequently switched to a state of being activated or to a state of being deactivated due to a fluctuation in the grayscale level caused by white noise or the like. The degree of the fluctuation in the grayscale level varies in accordance with the use or the like of the liquid crystal display apparatus. Therefore, the deactivation grayscale level difference threshold value ΔGLThR may be appropriately set in accordance with the use. There is no specific upper limit on the difference between the activation grayscale level difference threshold value ΔGLThA and the deactivation grayscale level difference threshold value ΔGLThR. The deactivation grayscale level difference threshold value ΔGLThR is set to, for example, at least about 5% of the difference between the maximum grayscale level and the minimum grayscale level. In the case where the deactivation grayscale level difference threshold value ΔGLThR is too small, an inconvenience may occur that once being activated, the clip processing is not deactivated even though the display is returned to the usual display that does not need clipping and thus the display quality is kept low.

In the above, the activation grayscale level difference threshold value ΔGLThA and the deactivation grayscale level difference threshold value ΔGLThR have been described. As described below, the same is applicable to the case where the threshold value of a voltage difference (an activation grayscale voltage difference threshold value ΔVGThA and a deactivation grayscale voltage difference threshold value ΔVGThR) is used instead of the grayscale level difference.

The difference between the activation pixel number threshold value NPThA and the deactivation pixel number threshold value NPThR is set to, for example, at least about 10% of the number of all the pixels belonging to the determination unit described above. In the case where the difference between the activation pixel number threshold value NPThA and the deactivation pixel number threshold value NPThR is too small, an inconvenience may occur that the clip processing is frequently switched to a state of being activated or to a state of being deactivated due to a fluctuation in the display pattern caused by white noise or the like. The degree of the fluctuation in the display pattern varies in accordance with the use or the like of the liquid crystal display apparatus. Therefore, the deactivation pixel number threshold value NPThR may be appropriately set in accordance with the use. There is no specific upper limit on the difference between the activation pixel number threshold value NPThA and the deactivation pixel number threshold value NPThR. The deactivation pixel number threshold value NPThR is set to, for example, at least about 10% of the number of all the pixels belonging to the determination unit described above. In the case where the deactivation pixel number threshold value NPThR is too small, an inconvenience may occur that once being activated, the clip processing is not deactivated even though the display is returned to the usual display that does not need clipping and thus the display quality is kept low.

Figure 6:
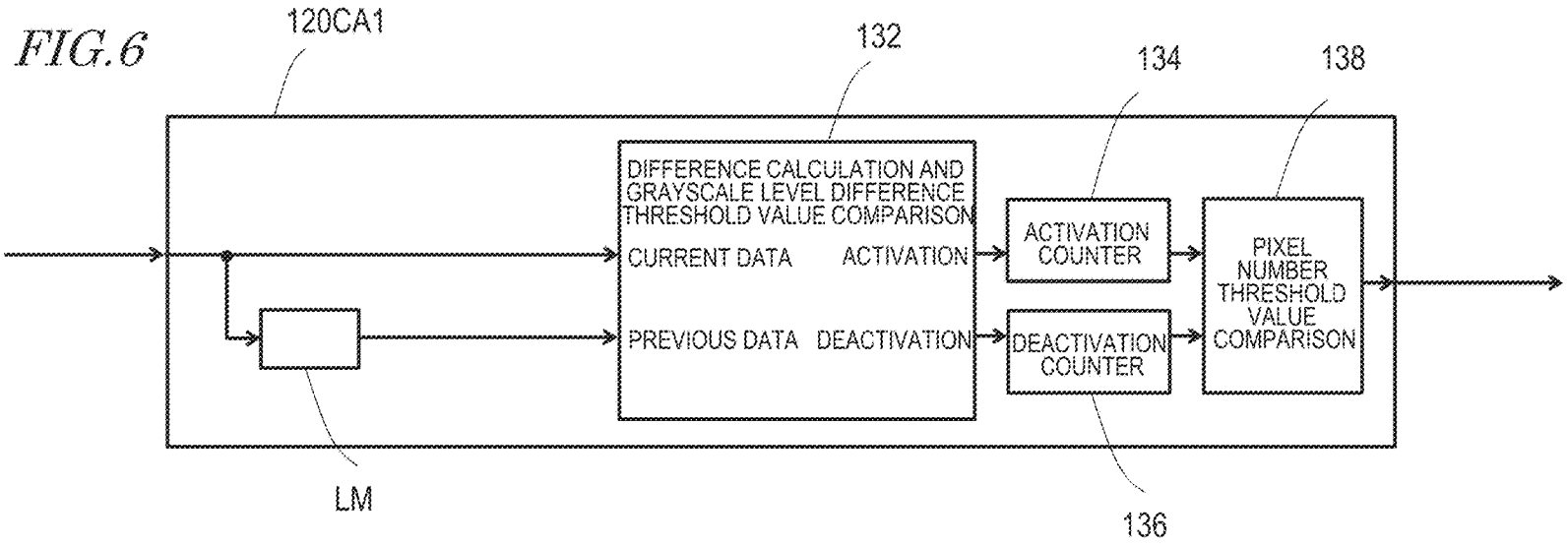
FIG. 6 is a schematic block diagram of a clip processing control circuit 120CA1 usable as a clip processing control circuit 120CA included in the display control circuit 12A.

As the clip processing control circuit 120CA shown in FIG. 5, a clip processing control circuit 120CA1 shown in FIG. 6 may be used, for example. FIG. 6 is a schematic block diagram of the clip processing control circuit 120CA1.

The clip processing control circuit 120CA1 includes a line memory LM, a difference comparison circuit 132, an activation counter 134, a deactivation counter 136, and a pixel number threshold value comparison circuit 138. The line memory LM stores data on the immediately previous horizontal scanning period ($HP_0$) immediately previous to the current horizontal scanning period ($HP_1$).

For each of the pixels in the determination unit, the difference comparison circuit 132 finds, regarding the input grayscale data, the absolute value $|\Delta GL|$ of the difference $\Delta GL$ between the grayscale level $GL_1$ in the current horizontal scanning period $HP_1$ and the grayscale level $GL_0$ in the immediately previous horizontal scanning period $HP_0$ (step A). The difference comparison circuit 132 further compares $|\Delta GL|$ and the predetermined activation grayscale level difference threshold value $\Delta GLThA$ with each other. In the case where $|\Delta GL|$ $\Delta GLThA$ is fulfilled, the difference comparison circuit 132 outputs activation "1". Otherwise, the difference comparison circuit 132 outputs activation "0". The difference comparison circuit 132 compares $|\Delta GL|$ and the predetermined deactivation grayscale level difference threshold value $\Delta GLThR$ ($<\Delta GLThA$) with each other. In the case where $|\Delta GL|$ $\Delta GLThR$ is fulfilled, the difference comparison circuit 132 outputs deactivation "1". Otherwise, the difference comparison circuit 132 outputs deactivation "0".

The above-described operation is performed throughout one vertical scanning period. As a result, based on a counter value of the activation counter 134 and a counter value of the deactivation counter 136, the number $NP_1$ of the first pixels fulfilling $|\Delta GL| \geq \Delta GLThA$ and the number $NP_2$ of the second pixels fulfilling $|\Delta GL| \geq \Delta GLThR$, among the pixels belonging to the determination unit, are found (step B1 and step B2). Step A, step B1 and step B2 are basically performed on all the pixels belonging to the determination unit, but may be performed on a part of such pixels.

The determination unit may be two or more pixel groups associated with the display control circuit 12A (i.e., two or more pixel groups controlled by the display control circuit 12A), or at least one pixel group among the two or more pixel groups associated with the display control circuit 12A (i.e., a pixel group corresponding to at least one source driving circuit 34 among two or more source driving circuits 34 connected with the display control circuit 12A).

Regarding, for example, a liquid crystal display apparatus including one display control circuit 12 like the liquid crystal display apparatus 100A shown in FIG. 4, in the case where the component to which a measure is to be taken against heat dissipation (e.g., the power supply control circuit 13 shown in FIG. 4) influences the entirety of the display region (all the pixel groups), one activation counter 134, one deactivation counter 136 and one pixel number threshold value comparison circuit 138 may be provided for all the pixels in the display region. By contrast, in the case where the component to which a measure is to be taken against heat dissipation (e.g., each source driving circuit 34 shown in FIG. 4) influences a part of the display region (e.g., one pixel group), one activation counter 134, one deactivation counter 136 and one pixel number threshold value comparison circuit 138 may be provided for, for example, each of the pixel groups or for each of pixel group assemblies each formed of any number of pixel groups that is two or greater.

The pixel number threshold value comparison circuit 138 compares the above-mentioned counter values with the activation pixel number threshold value and the deactivation pixel number threshold value with each other, and generates the clip processing control signal (including an instruction of either "activation", "maintenance" or "deactivation") as follows in each one vertical scanning period (step D).

The number $NP_1$ of the first pixels and the predetermined activation pixel number threshold value NPThA are compared with each other. In the case where $NP_1 \geq NPThA$ is "true", "activation" is generated.

The number $NP_1$ of the first pixels and the predetermined activation pixel number threshold value NPThA are compared with each other, and $NP_1 \geq NPThA$ is "false", and the number $NP_2$ of the second pixels and the predetermined deactivation pixel number threshold value NPThR are compared with each other, and $NP_2 \geq NPThR$ is "true". In this case, "maintenance" is generated.

The number $NP_2$ of the second pixels and the predetermined deactivation pixel number threshold value NPThR are compared with each other. In the case where $NP_2 \geq NPThR$ is "false", "deactivation" is generated.

In the case of performing the determination step with each of the pixel groups being the determination unit, the clip processing control circuit 120CA1 may generate the clip processing control signal as follows (including an instruction of either "activation", "maintenance" or "deactivation") (step D).

The number $NP_1$ of the first pixels and the predetermined pixel number threshold value NPThA are compared with each other regarding at least one pixel group. In the case where $NP_1 \geq NPThA$ is "true", "activation" is generated.

The number $NP_1$ of the first pixels and the predetermined activation pixel number threshold value NPThA are compared with each other regarding all of the two or more pixel groups associated as described above, and $NP_1 \geq NPThA$ is "false", and the number $NP_2$ of the second pixels and the predetermined deactivation pixel number threshold value NPThR are compared with each other regarding at least one pixel group among the two or more pixel groups associated as described above, and $NP_2 \geq NPThR$ is "true". In this case, "maintenance" is generated.

The number $NP_2$ of the second pixels and the predetermined deactivation pixel number threshold value NPThR are compared with each other regarding all of the two or more pixel groups associated as described above. In the case where $NP_2 \geq NPThR$ is "false", "deactivation" is generated.

Needless to say, the determination unit is not limited to being each pixel group. The determination unit may be any number of pixel groups that is two or greater.

Step A, step B1 and step B2are performed during the effective display period (Vdisp) included in one vertical scanning period. Step C1, step C2 and step D are performed after step B1 and step B2 are finished but before the one vertical scanning period is finished.

Figure 7:
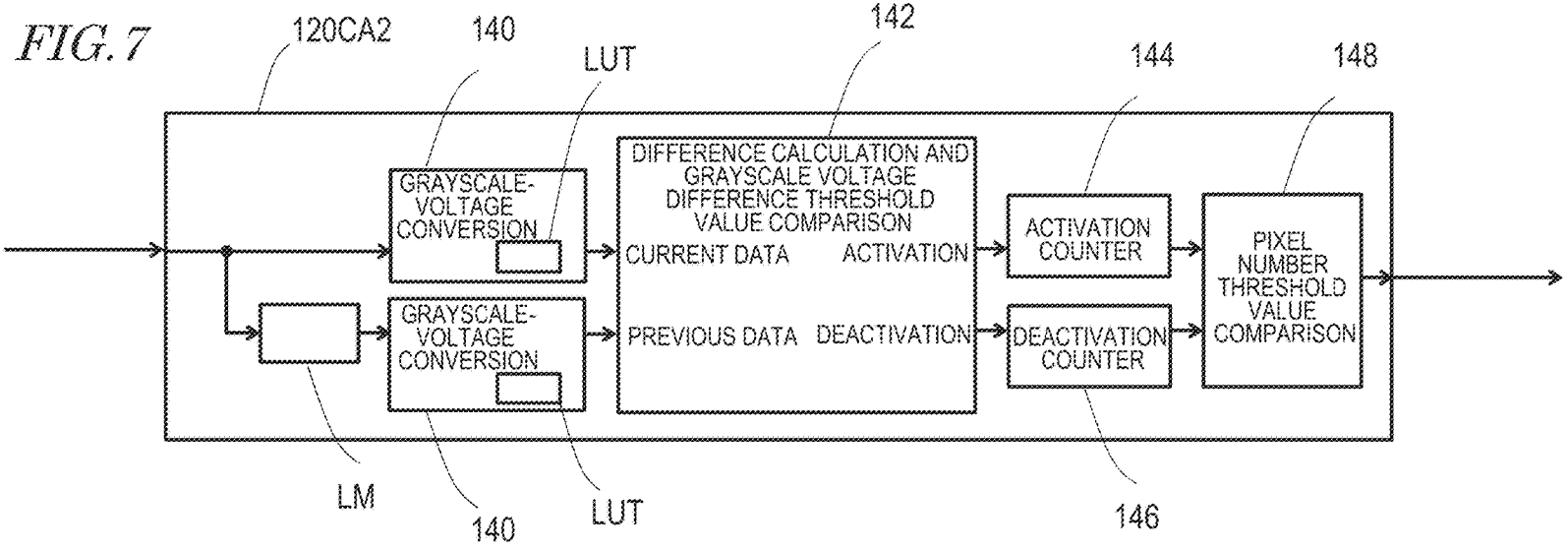
FIG. 7 is a schematic block diagram of a clip processing control circuit 120CA2 usable as the clip processing control circuit 120CA included in the display control circuit 12A.

Instead of the clip processing control circuit 120CA1 shown in FIG. 6, a clip processing control circuit 120CA2 shown in FIG. 7 may be used. FIG. 7 is a schematic block diagram of the clip processing control circuit 120CA2.

The clip processing control circuit 120CA2 includes a line memory LM, grayscale-voltage conversion circuits 140, a difference comparison circuit 142, an activation counter 144, a deactivation counter 146, and a pixel number threshold value comparison circuit 148. The clip processing control circuit 120CA2 includes the grayscale-voltage conversion circuits 140 converting grayscale data into voltage data. Herein, the clip processing control circuit 120CA2 includes the grayscale-voltage conversion circuit 140 converting the grayscale level in the current horizontal scanning period ($HP_1$) into a grayscale voltage corresponding thereto, and the grayscale-voltage conversion circuit 140 converting the grayscale level in the immediately previous horizontal scanning period ($HP_0$) read from the line memory LM into a grayscale voltage corresponding thereto. The grayscale-voltage conversion circuits 140 use, for example, an LUT to convert the grayscale level into the corresponding grayscale voltage.

The difference comparison circuit 142 is supplied with first input grayscale voltage data provided by the first input grayscale data being converted by the grayscale-voltage conversion circuits 140. For each of the pixels belonging to the determination unit, the difference comparison circuit 142 finds, regarding the first input grayscale voltage data, an absolute value $|\Delta VG|$ of a difference $\Delta VG$ (subtraction result) between a grayscale voltage $VG_1$ in the current horizontal scanning period $HP_1$ and a grayscale voltage $VG_0$ in the immediately previous horizontal scanning period $HP_0$ immediately previous to the current horizontal scanning period $HP_1$ (step A). The difference comparison circuit 142 further compares $|\Delta VG|$ and the predetermined activation grayscale voltage difference threshold value $\Delta VGThA$ with each other. In the case where $|\Delta VG| \geq \Delta VGThA$ is fulfilled, the difference comparison circuit 142 outputs activation "1". Otherwise, the difference comparison circuit 142 outputs activation "0". The difference comparison circuit 142 compares $|\Delta VG|$ and the predetermined deactivation grayscale voltage difference threshold value $\Delta VGThR$ ($<\Delta VGThA$). In the case where $|\Delta VG| \geq \Delta VGThR$ is fulfilled, the difference comparison circuit 142 outputs deactivation Otherwise, the difference comparison circuit 142 outputs deactivation "0".

The above-described operation is performed throughout one vertical scanning period. As a result, based on a counter value of the activation counter 144 and a counter value of the deactivation counter 146, the number $NP_1$ of first pixels fulfilling $|\Delta VG| \geq \Delta VGThA$ and the number $NP_2$ of second pixels fulfilling $|\Delta VG| \geq \Delta VGThR$, among the pixels belonging to the determination unit, are found (step B1 and step B2). Step A, step B1 and step B2 are basically performed on all the pixels belonging to the determination unit, but may be performed on a part of such pixels.

The pixel number threshold value comparison circuit 148 compares the above-mentioned counter value with the activation pixel number threshold value and the deactivation pixel number threshold value in each one vertical scanning period, and generates the clip processing control signal (including an instruction of either "activation", "maintenance" or "deactivation") as follows (step D).

The difference comparison circuit 142, the activation counter 144, the deactivation counter 146 and the pixel number threshold value comparison circuit 148 included in the clip processing control circuit 120CA2 have substantially the same functions as those of the difference comparison circuit 132, the activation counter 134, the deactivation counter 136 and the pixel number threshold value comparison circuit 138 included in the clip processing control circuit 120CA1.

At this point, the clip processing circuit 120PA performs the clip processing of limiting the grayscale level of the first input grayscale data to a predetermined range, in accordance with the clip processing control signal.

As described above, the grayscale data is converted into the grayscale voltage data, and the determination step is performed based on the grayscale voltage difference instead of the grayscale level difference. Thus, the precision of detecting the display for which the clip processing is to be performed may be increased.

In order to increase the effect of the clipping, it is needed to activate the clip processing on a wider variety of display patterns. Thus, the grayscale level difference threshold value and/or the pixel number threshold value is set to be small. In accordance with this, it is preferred to increase the amount of clipping (the number of grayscale levels that are lost by the clip processing). At this point, care should be taken to prevent the clip processing from being activated on the usual display. In general, the heat generation in a circuit component is in positive correlation with the power consumption. The power consumption of a circuit component having a large output current is "input power-output power", and is also called "power loss". Regarding the heat generation in the source drivers according to an embodiment of the present invention, the following is known empirically. In the case where all the connected source signals have the same voltage waveform of repeating a certain amplitude in one frame, the heat generation is generally in proportion to the amplitude and the frequency of the voltage waveform. In the case where a part of the connected source signals have the same voltage waveform of repeating a certain amplitude in one frame and the rest of the connected source signals have a voltage waveform of not oscillating in one frame, the heat generation is generally in proportion to the number of the former source signals. Namely, regarding the power loss of a component related to the driving of the source signals (the source driver or the power supply control circuit), the amplitude and the frequency of the source signals are considered to be equivalent to the number of the source signals. The amplitude and the frequency of the source signals respectively represent the voltage change amount of the source signals that may have the voltage thereof changed on a horizontal scanning period-by-horizontal scanning period basis and the frequency at which the change occurs.

Figure 8:
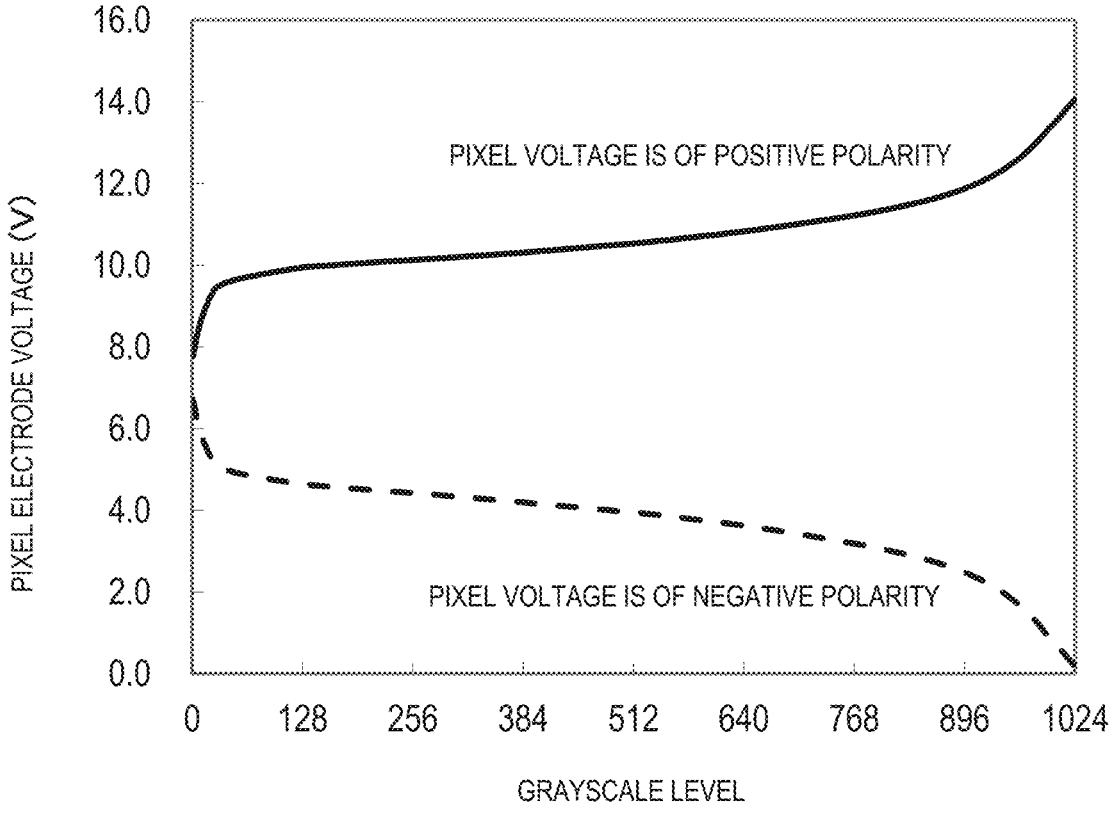
FIG. 8 is a graph showing an example of grayscale-voltage characteristic of a liquid crystal display panel.

With reference to FIG. 8, advantages of performing the determination step based on the grayscale voltage difference will be described. FIG. 8 is a graph showing an example of grayscale-voltage curve of a display panel. The horizontal axis represents the grayscale level (1024 grayscale; grayscale levels 0-1023), and the vertical axis represents the pixel electrode voltage (V). The common electrode has a voltage (Vcom) of 7.8 V, and the difference between the pixel electrode voltage and the common electrode voltage is applied to the pixel (liquid crystal layer). The difference between the pixel electrode voltage and the common electrode voltage may be referred to as a "pixel voltage". In FIG. 8, the solid line indicates that the pixel electrode is of a positive polarity, and the dotted line indicates that the pixel electrode is of a negative polarity.

As can be seen from FIG. 8, the relationship between the grayscale level and the pixel voltage (grayscale voltage) is not linear. Therefore, in the case where the determination step is performed based on the grayscale level difference, the detection precision may be decreased. Even if the detection precision is low, the clip processing is not activated on the usual display as long as the grayscale level difference threshold value and/or the pixel number threshold value is large. In the case where the grayscale level difference threshold value and/or the pixel number threshold value is made small, the clip processing may possibly be activated even on the usual display. Therefore, in this case, it is preferred to increase the detection precision.

Now, pay attention to the curve (solid line) of the positive polarity in FIG. 8. The maximum value of the pixel voltage is (14.1−7.8)=6.3 V. When the grayscale level difference threshold value (activation) is set based on about 50% of 6.3 V, namely, based on 3.2 V, the minimum grayscale level difference corresponding to 3.2 V is about 384 grayscale levels. In the case where the grayscale voltage difference threshold value is set to 50% because of the above-described relationship of equivalence, the pixel number (area size, frequency) threshold value is also set to about 50%. The possibility that the pixels having a grayscale level difference as large as about 384 grayscale levels are included at a ratio of about 50% in the usual display is very low. Therefore, the clip processing is not activated almost at all, which causes no problem. By contrast, in the case where the grayscale level difference threshold value (activation) is set based on about 25% of the maximum value of the pixel voltage, namely, based on 1.6 V, the minimum grayscale level difference corresponding to 1.6 V is about 32 grayscale levels. In this case, the grayscale levels of pixels adjacent to each other in the vertical direction are, for example, grayscale levels 0-32, grayscale levels 128-160, or grayscale levels 223-225, which are highly possibly included in the usual display. The possibility that the clip processing is activated is high, which may cause a problem that the display quality is decreased by the clipping.

Now, 1.6 V is set as the grayscale voltage difference threshold value. In this case, as understood from the grayscale-voltage curve in FIG. 8, only the difference between grayscale levels 0-32 fulfills the condition of being larger than, or equal to, the grayscale voltage difference threshold value. Neither the difference between grayscale levels 128-160 nor the difference between grayscale levels 223-255 fulfills the condition of being larger than, or equal to, the grayscale voltage difference threshold value. Therefore, the threshold value may be set based on the grayscale voltage difference, so that the pixels for which the clip processing is to be activated may be selected effectively.

In the grayscale-voltage curve shown in FIG. 8, the inclination on the low grayscale side is steeper than the inclination on the high grayscale side. Therefore, in the case where, for example, the required effect of suppressing the power consumption is not very large, the clip processing performed on the low grayscale side may make the amount of clipping smaller, and thus may influence less on the display, than the clip processing performed on the high grayscale side. Even on the low grayscale side, the grayscale-voltage curve has is the mildest region beyond the steep region. Therefore, in the case where the required effect of suppressing the power consumption is of a certain level or larger, it may be more efficient to perform the clip processing on the high grayscale side. In the case where the clip processing is activated only on the high grayscale side, the maximum luminance (white) is suppressed in the display. In the case where the clip processing is activated only on the low grayscale side, the minimum luminance (black) is unnecessarily brightened in the display. To which grayscale level the high grayscale side and/or the low grayscale side is to be clipped may be determined in consideration of such a trade-off as well as the required degree of effect of suppressing the power consumption.

Now, with reference to FIG. 9 and FIG. 10, specific examples of the change in the display pattern and the on/off change of the clip processing will be described. The conditions for the specific examples shown herein are as follows.

Number of pixels in the X direction (row direction): 3840; number of pixels in the Y direction (column direction): 2160

Total number of pixels: 24883200

Grayscale levels represented by 12 bits (4096 grayscale; grayscale levels 0-4095)

Figure 9:
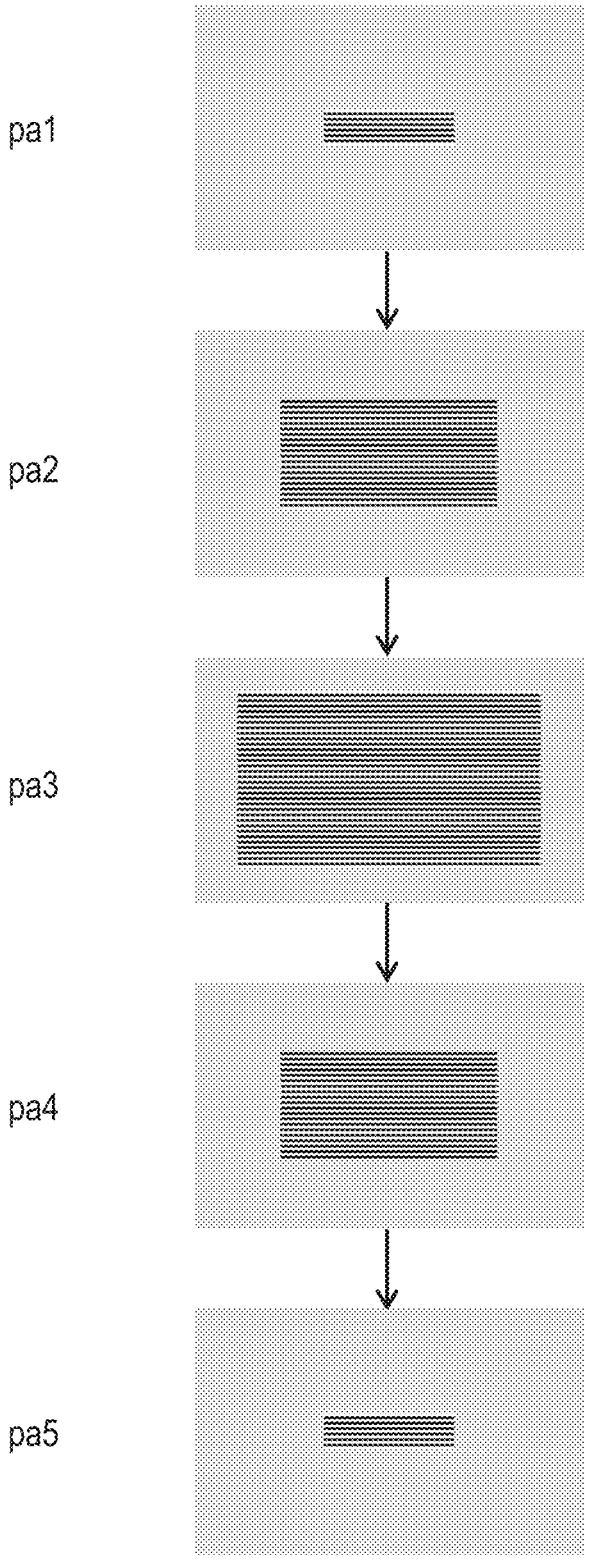
FIG. 9 shows an example in which the area size of display patterns having a large difference in the grayscale level between horizontal stripes changes symmetrically as represented by a change from display patterns pa1 through pa5.

Activation grayscale level difference threshold value ΔGLThA: 1536 grayscale level difference Deactivation grayscale level difference threshold value ΔGLThR: 512 grayscale level difference Activation pixel number threshold value NPThA: 12440000 pixels Deactivation pixel number threshold value NPThR: 6220000 pixels FIG. 9 shows an example in which the area size of display patterns having a large grayscale level difference (|ΔGL|=4095) between horizontal stripes (the area size corresponds to the number of pixels) changes symmetrically as represented by display pattern pa1 through display pattern pa5, in which the area size changes from small→middle→large→middle→small. The details of display patterns pa1 through pa5 are as shown in Tables 1 through 5.

In Tables 1 through 5 (and Tables 6 through 10) shown below, the "display pattern" is characterized by a "gray plain area" (area displaying a certain intermediate level: 2048/4096), "horizontal stripe area" (area displaying a pattern in which two grayscale levels having a grayscale level difference |ΔGL| appear on a pixel row-by-pixel row basis), and a "border area" therebetween. The "main area" refers to the "area other than the border area". "X" refers to the number of pixels in the X direction, "Y" refers to the number of pixels in the Y direction, and the "number of pixels" refers to the number of pixels included in each area (including the "border area"). The "activation count" refers to, in each area, the number of pixels (refers to the value counted by the activation counter) that fulfill |ΔGL|≥ΔGLThA for the activation grayscale level difference threshold value ΔGLThA (1536 grayscale level difference). The "deactivation count" refers to, in each area, the number of pixels (refers to the value counted by the deactivation counter) that fulfill |ΔGL|≥ΔGLThR for the deactivation grayscale level difference threshold value ΔGLThR (512 grayscale level difference). The "determination" refers to the result of determination found as follows. The total ($NP_1$) of the "activation counter" and the activation pixel number threshold value NPThA (12440000 pixels) are compared with each other, and it is determined whether or not $NP_1 \geq NPThA$ is fulfilled. The total ($NP_2$) of the "deactivation counter" and the deactivation pixel number threshold value NPThR (6220000 pixels) are compared with each other, and it is determined whether or not $NP_2 \geq NPThR$ is fulfilled. Based on the two results, the determination (whether the clip processing is to be activated, deactivated or maintained) is made. The "clip" indicates whether the clip processing is on or off as a result of the determination.

TABLE 1

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 960 | 809 | 2329920 | 0 | 0 | | |
| HORIZON-TAL | BORDER AREA | | 2048 | | 1 | 2880 | 2880 | 2880 | | |

TABLE 1-continued

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| STRIPE AREA | MAIN AREA | 0<br>4095 | 4095 | | 540 | 1555200 | 1555200 | 1555200 | | |
| GRAY PLAIN AREA | BORDER AREA | | 2047 | | 1 | 2880 | 2880 | 2880 | | |
| | MAIN AREA | 2048 | 0 | | 809 | 2329920 | 0 | 0 | | |
| | | — | | | | TOTAL | 1560960 | 1560960 | DEACTI-VATE | OFF |

TABLE 2

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 1920 | 539 | 3104640 | 0 | 0 | | |
| HORIZON-TAL STRIPE AREA | BORDER AREA | | 2048 | | 1 | 5760 | 5760 | 5760 | | |
| | MAIN AREA | 0<br>4095 | 4095 | | 1080 | 6220800 | 6220800 | 6220800 | | |
| GRAY PLAIN AREA | BORDER AREA | | 2047 | | 1 | 5760 | 5760 | 5760 | | |
| | MAIN AREA | 2048 | 0 | | 539 | 3104640 | 0 | 0 | | |
| | | — | | | | TOTAL | 6232320 | 6232320 | MAINTAIN | OFF |

TABLE 3

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 2880 | 269 | 2324160 | 0 | 0 | | |
| HORIZON-TAL STRIPE AREA | BORDER AREA | | 2048 | | 1 | 8640 | 8640 | 8640 | | |
| | MAIN AREA | 0<br>4095 | 4095 | | 1620 | 13996800 | 13996800 | 13996800 | | |
| GRAY PLAIN AREA | BORDER AREA | | 2047 | | 1 | 8640 | 8640 | 8640 | | |
| | MAIN AREA | 2048 | 0 | | 269 | 2324160 | 0 | 0 | | |
| | | — | | | | TOTAL | 14014080 | 14014080 | ACTIVATE | ON |

TABLE 4

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 1920 | 539 | 3104640 | 0 | 0 | | |
| HORIZON-TAL STRIPE AREA | BORDER AREA | | 2048 | | 1 | 5760 | 5760 | 5760 | | |
| | MAIN AREA | 0<br>4095 | 4095 | | 1080 | 6220800 | 6220800 | 6220800 | | |
| GRAY PLAIN | BORDER AREA | | 2047 | | 1 | 5760 | 5760 | 5760 | | |

TABLE 4-continued

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| AREA | MAIN AREA | 2048 | 0 | | 539 | 3104640 | 0 | 0 | | |
| | | — | | | | TOTAL | 6232320 | 6232320 | MAINTAIN | ON |

TABLE 5

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 960 | 809 | 2329920 | 0 | 0 | | |
| HORIZON-TAL STRIPE AREA | BORDER AREA | | 2048 | | 1 | 2880 | 2880 | 2880 | | |
| | MAIN AREA | 0<br>4095 | 4095 | | 540 | 1555200 | 1555200 | 1555200 | | |
| GRAY PLAIN AREA | BORDER AREA | | 2047 | | 1 | 2880 | 2880 | 2880 | | |
| | MAIN AREA | 2048 | 0 | | 809 | 2329920 | 0 | 0 | | |
| | | — | | | | TOTAL | 1560960 | 1560960 | DEACTI-VATE | OFF |

The clip is off in display pattern pa1, is maintained off in display pattern pa2, is switched on in display pattern pa3, is maintained on in display pattern pa4, and is switched off in display pattern pa5. Although display pattern pa2 and display pattern pa4 are the same display pattern, clip is off in display pattern pa2 and is on in display pattern pa4. As can be seen, there are two different threshold values, namely, the activation pixel number threshold value NPThA and the deactivation pixel number threshold value NPThR, as the pixel number threshold value (area size threshold value). Therefore, hysteresis occurs at the on/off change of the clip processing.

Figure 10:
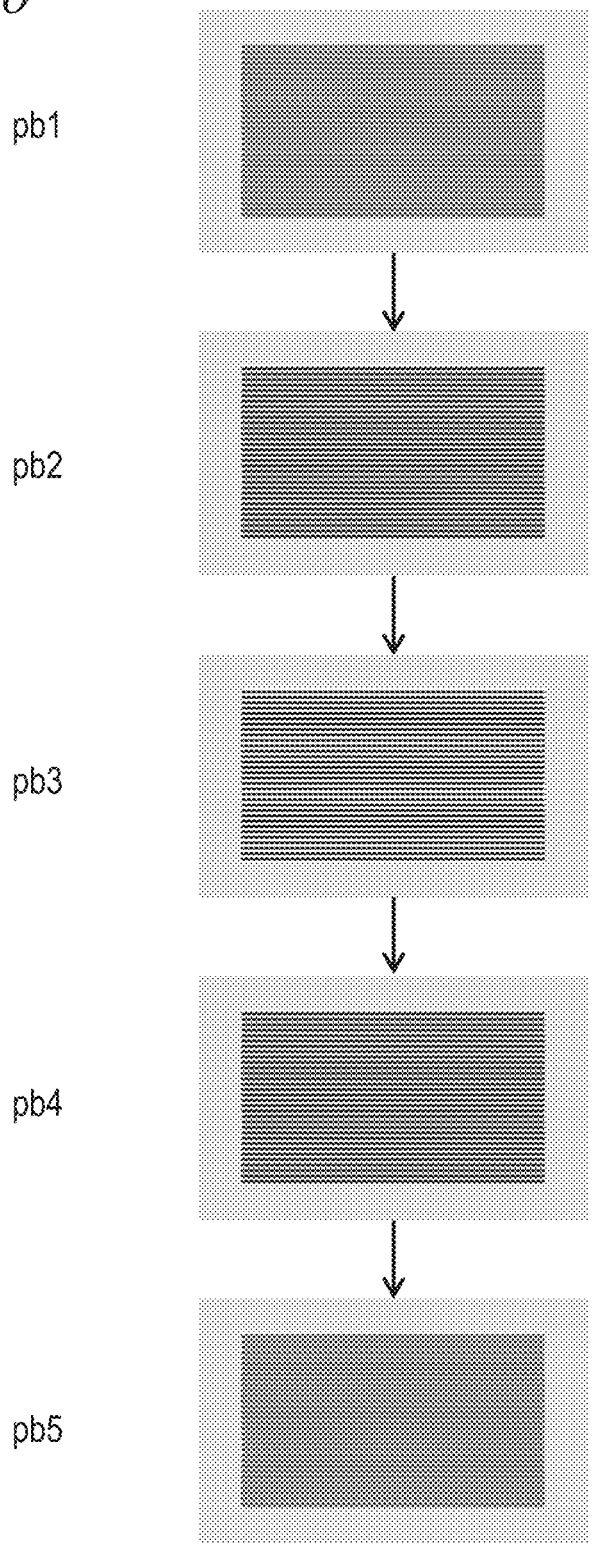
FIG. 10 shows an example in which the difference in the grayscale level of horizontal stripe display patterns having a large area size changes symmetrically as represented by a change from display patterns pb1 through pb5.

FIG. 10 shows an example in which the grayscale level difference in horizontal stripe display patterns having a large area size (corresponding to the number of pixels) changes symmetrically as represented by display pattern pb1 through display pattern pb5, in which the grayscale level difference changes from small→middle→large→middle→small. The details of display patterns pb1 through pb5 are as shown in Tables 6 through 10.

TABLE 6

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 2880 | 269 | 2324160 | 0 | 0 | | |
| HORIZON-TAL STRIPE AREA | BORDER AREA | | 128 | | 1 | 8640 | 0 | 0 | | |
| | MAIN AREA | 1920<br>2176 | 256 | | 1620 | 13996800 | 0 | 0 | | |
| GRAY PLAIN AREA | BORDER AREA | | 128 | | 1 | 8640 | 0 | 0 | | |
| | MAIN AREA | 2048 | 0 | | 269 | 2324160 | 0 | 0 | | |
| | | — | | | | TOTAL | 0 | 0 | DEACTI-VATE | OFF |

TABLE 7

| DISPLAY PATTERN | | GRAY-SCALE LEVEL | \| ΔGL \| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 2880 | 269 | 2324160 | 0 | 0 | | |

TABLE 7-continued

| DISPLAY PATTERN | | GRAY-SCALE LEVEL | \|ΔGL\| | X | Y | NUMBER OF PIXELS | ACTI-VATION COUNT | DEACTI-VATION COUNT | DETER-MINATION | CLIP |
|---|---|---|---|---|---|---|---|---|---|---|
| HORIZON-TAL STRIPE AREA | BORDER AREA | | 640 | | 1 | 8640 | 0 | 8640 | | |
| | MAIN AREA | 1408 2688 | 1280 | | 1620 | 13996800 | 0 | 13996800 | | |
| GRAY PLAIN AREA | BORDER AREA | | 640 | | 1 | 8640 | 0 | 8640 | | |
| | MAIN AREA | 2048 | 0 | | 269 | 2324160 | 0 | 0 | | |
| | | — | | | | TOTAL | 0 | 14014080 | MAINTAIN | OFF |

TABLE 8

| DISPLAY PATTERN | | GRAY-SCALE LEVEL | \|ΔGL\| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 2880 | 269 | 2324160 | 0 | 0 | | |
| HORIZON-TAL STRIPE AREA | BORDER AREA | | 2048 | | 1 | 8640 | 8640 | 8640 | | |
| | MAIN AREA | 0 4095 | 4095 | | 1620 | 13996800 | 13996800 | 13996800 | | |
| GRAY PLAIN AREA | BORDER AREA | | 2047 | | 1 | 8640 | 8640 | 8640 | | |
| | MAIN AREA | 2048 | 0 | | 269 | 2324160 | 0 | 0 | | |
| | | — | | | | TOTAL | 14014080 | 14014080 | ACTIVATE | ON |

TABLE 9

| DISPLAY PATTERN | | GRAY-SCALE LEVEL | \|ΔGL\| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 2880 | 269 | 2324160 | 0 | 0 | | |
| HORIZON-TAL STRIPE AREA | BORDER AREA | | 640 | | 1 | 8640 | 0 | 8640 | | |
| | MAIN AREA | 1408 2688 | 1280 | | 1620 | 13996800 | 0 | 13996800 | | |
| GRAY PLAIN AREA | BORDER AREA | | 640 | | 1 | 8640 | 0 | 8640 | | |
| | MAIN AREA | 2048 | 0 | | 269 | 2324160 | 0 | 0 | | |
| | | — | | | | TOTAL | 0 | 14014080 | MAINTAIN | ON |

TABLE 10

| DISPLAY PATTERN | | GRAY-SCALE LEVEL | \|ΔGL\| | X | Y | NUMBER OF PIXELS | ACTI-VATION COUNT | DEACTI-VATION COUNT | DETER-MINATION | CLIP |
|---|---|---|---|---|---|---|---|---|---|---|
| GRAY PLAIN AREA | MAIN AREA | 2048 | 0 | 2880 | 269 | 2324160 | 0 | 0 | | |
| HORIZON-TAL STRIPE AREA | BORDER AREA | | 128 | | 1 | 8640 | 0 | 0 | | |
| | MAIN AREA | 1920 2176 | 256 | | 1620 | 13996800 | 0 | 0 | | |
| GRAY PLAIN | BORDER AREA | | 128 | | 1 | 8640 | 0 | 0 | | |

TABLE 10-continued

| DISPLAY PATTERN | | GRAY-SCALE LEVEL | \|ΔGL\| | X | Y | NUMBER OF PIXELS | ACTI-VATION COUNT | DEACTI-VATION COUNT | DETER-MINATION | CLIP |
|---|---|---|---|---|---|---|---|---|---|---|
| AREA | MAIN AREA | 2048 | 0 | | 269 | 2324160 | 0 | 0 | | |
| | | — | | | | TOTAL | 0 | 0 | DEACTI-VATE | OFF |

The clip is off in display pattern pb1, is maintained off in display pattern pb2, is switched on in display pattern pb3, is maintained on in display pattern pb4, and is switched off in display pattern pb5. Although display pattern pb2 and display pattern pb4 are the same display pattern, clip is off in display pattern pb2 and is on in display pattern pb4. As can be seen, there are two different threshold values, namely, the activation grayscale level difference threshold value ΔGLThA and the deactivation grayscale level difference threshold value ΔGLThR, as the grayscale level difference threshold value. Therefore, hysteresis occurs at the on/off change of the clip processing.

Figure 11:
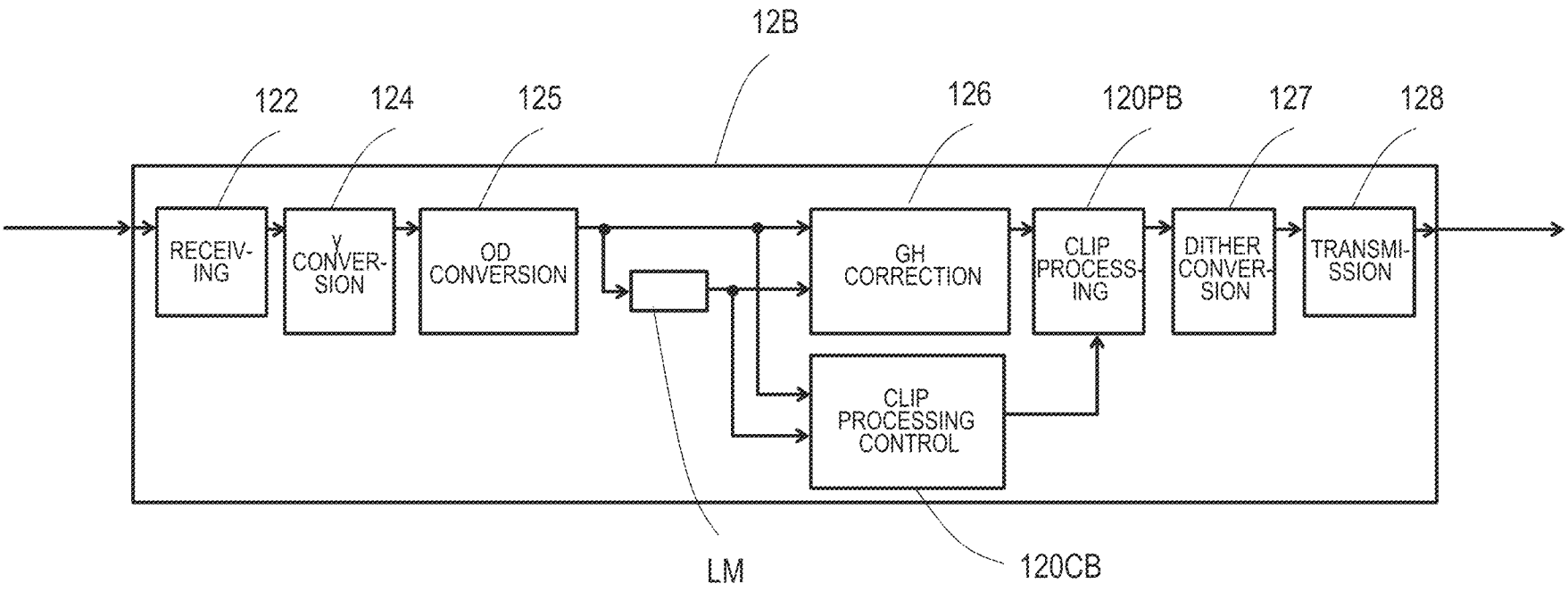
FIG. 11 is a schematic block diagram of a display control circuit 12B included in a liquid crystal display apparatus according to a second embodiment of the present invention.

FIG. 11 shows a schematic block diagram of a display control circuit 12B included in a liquid crystal display apparatus according to a second embodiment of the present invention.

In the display control circuit 12A shown in FIG. 5, the GH correction circuit 126 and the clip processing control circuit 120CA each includes the line memory LM. In contrast, in the display control circuit 12B shown in FIG. 11, the GH correction circuit 126 and the clip processing control circuit 120CB share the line memory LM. Such a configuration may suppress an increase in the circuit scale without decreasing the performance.

Figure 12:
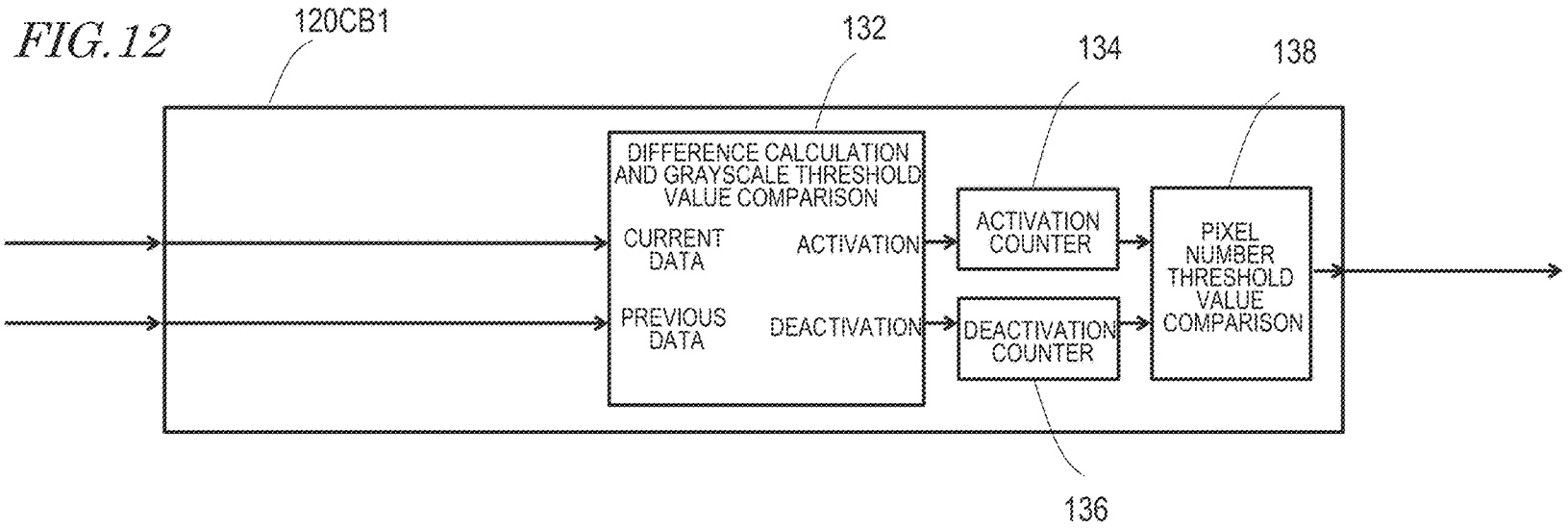
FIG. 12 is a schematic block diagram of a clip processing control circuit 120CB1 usable as a clip processing control circuit 120CB included in the display control circuit 12B.

FIG. 12 is a schematic block diagram of a clip processing control circuit 120CB1 usable as a clip processing control circuit 120CB included in the display control circuit 12B. The clip processing control circuit 120CB1 shares the line memory LM with the GH correction circuit 126, and thus does not include the line memory LM, which is the only difference between the clip processing control circuit 120CB1 and the clip processing control circuit 120CA1 shown in FIG. 6.

Figure 13:
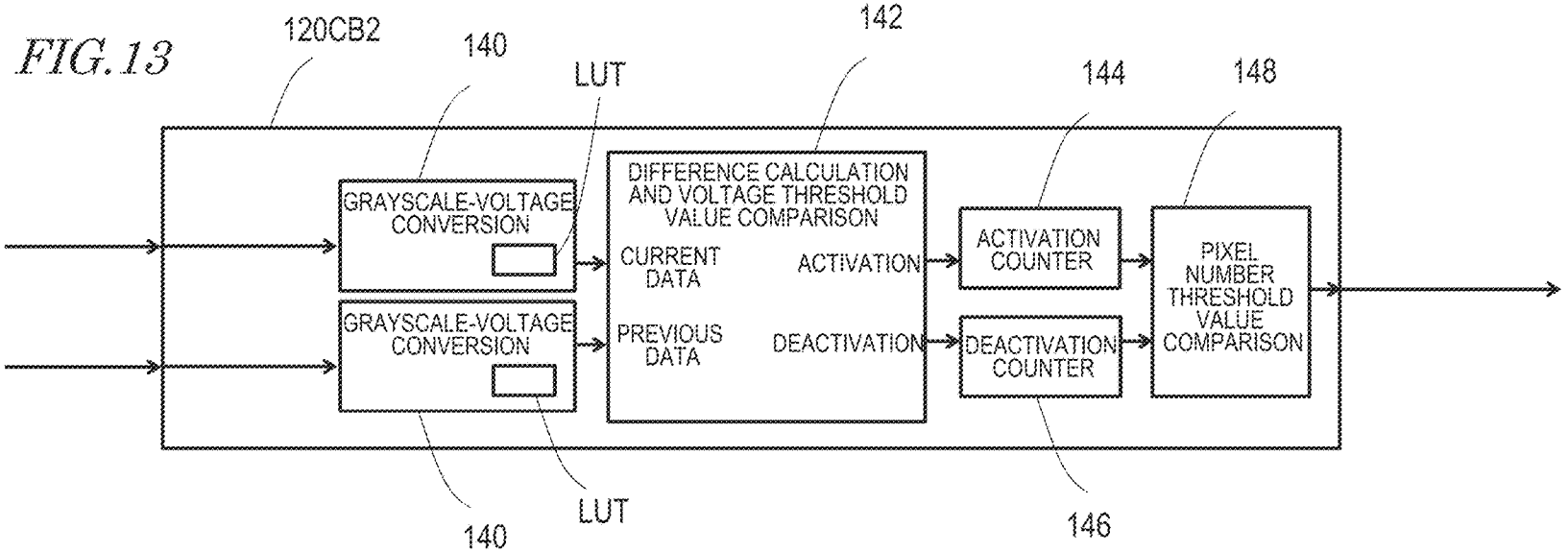
FIG. 13 is a schematic block diagram of a clip processing control circuit 120CB2 usable as the clip processing control circuit 120CB included in the display control circuit 12B.

FIG. 13 is a schematic block diagram of a clip processing control circuit 120CB2 usable as the clip processing control circuit 120CB included in the display control circuit 12B. The clip processing control circuit 120CB2 shares the line memory LM with the GH correction circuit 126, and thus does not include the line memory LM, which is the only difference between the clip processing control circuit 120CB2 and the clip processing control circuit 120CA2 shown in FIG. 7.

Figure 14:
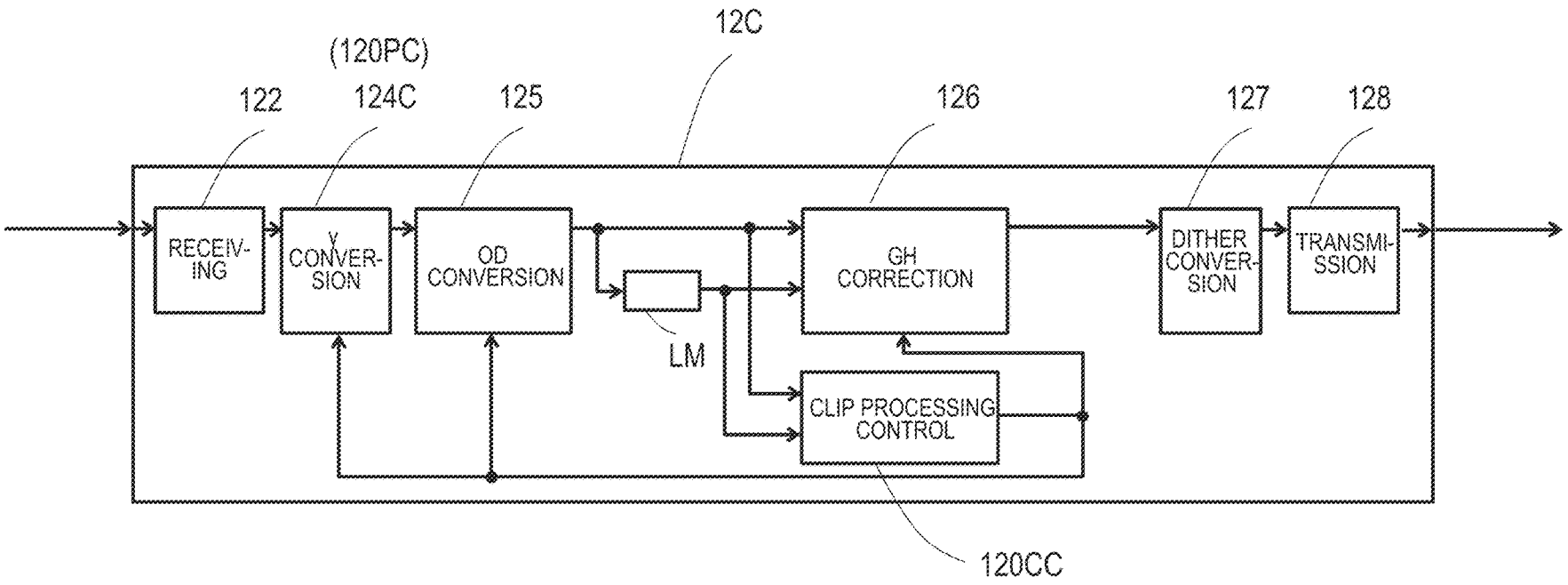
FIG. 14 is a schematic block diagram of a display control circuit 12C included in a liquid crystal display apparatus according to a third embodiment of the present invention.

FIG. 14 is a schematic block diagram of a display control circuit 12C included in a liquid crystal display apparatus according to a third embodiment of the present invention.

Like in the display control circuit 12B shown in FIG. 11, in the display control circuit 12C, a clip processing control circuit 120CC and the GH correction circuit 126 share the line memory LM. In addition, the function of the clip processing circuit 120PB is provided by a γ conversion circuit 124C. Namely, the γ conversion circuit 124C in the display control circuit 12C also acts as a clip processing circuit 120PC. Such a configuration may further suppress the increase in the circuit scale. The clip processing control circuit 120CC may be the same as the clip processing control circuit 120BC shown in FIG. 11. The clip processing control circuit 120CB1 shown in FIG. 12 or the clip processing control circuit 120CB2 shown in FIG. 13 may be used as the clip processing control circuit 120CC.

The γ conversion circuit 124C uses, for example, an LUT to perform the γ conversion. Upon receipt of a clip processing control signal of activating the clip processing from the clip processing control circuit 120CC, the γ conversion circuit 124C changes the value of the LUT (or the LUT to be referred to) so as to allow desired clip processing to be performed. In this manner, the γ conversion circuit 124C acts as the clip processing circuit 120PC. Upon receipt of a clip processing control signal of deactivating the clip processing from the clip processing control circuit 120CC, the γ conversion circuit 124C returns the value of the LUT to the original value for the γ conversion (or to the original LUT).

A change in the LUT value to be used by the γ conversion circuit 124C changes the input grayscale data to be input to the OD conversion circuit 125. As a result, the first input grayscale data to be input to the clip processing control circuit 120CC is also changed. In order to prevent such a change from repeatedly switching the clip processing control signal that is output from the clip processing control circuit 120CC between a signal instructing activation and a signal instructing deactivation, the display control circuit 12C may be set such that the OD conversion is not performed when the LUT value is changed for the clip processing. The display control circuit 12C may be set such that when the clip processing is performed, the GH correction is not performed thereafter. This may suppress the effect of the clip processing from decreasing as a result of the GH correction.

In such a configuration, the clip processing control circuit 120CC is located on a stage after the γ conversion circuit 124C (clip processing circuit 120PC). Therefore, in order to avoid an endless loop, it is preferred that the deactivation threshold value (the deactivation grayscale level difference threshold value or the deactivation grayscale voltage difference threshold value) is set to be small.

The endless loop is caused in the following case, for example. The conditions for the specific examples are as follows.

Grayscale levels represented by 12 bits (4096 grayscale; grayscale levels 0-4095)

Activation grayscale level difference threshold value ΔGLThA: 2000 grayscale level difference Deactivation grayscale level difference threshold value ΔGLThR: 1500 grayscale level difference High grayscale clip value: 3000 grayscale levels (amount of clipping on the high grayscale side: 1095 grayscale levels)

Low grayscale clip value: 1000 grayscale levels (amount of clipping on the low grayscale side: 1000 grayscale levels)

The LUT of the γ conversion circuit 124 has a value by which the output from the γ conversion circuit 124 is equal to the input thereto when the clip processing is not performed. Now, an operation on a display pattern (still picture) will be discussed in the case where the black and white horizontal stripes each corresponding to one pixel row have an area size of 100% and the grayscale levels thereof are 0 and 2500.

(1) 2500−0=2500 >2000. Therefore, the clip processing is activated, and the clip processing is switched on.

(2) In the case where the clip processing is switched on, when the inputs to the γ conversion circuit 124 are grayscale levels 0 and 2500, the outputs from the γ conversion circuit 124 are grayscale levels 2000 and 2500.

(3) 2500−2000=500<1500. Therefore, when these outputs are input to the clip processing control circuit 120CC, the clip processing is deactivated, and the clip processing is switched off.

(4) Then, when the inputs to the γ conversion substrate 124C are grayscale levels 2 and 2500, the outputs from the γ conversion substrate 124C are grayscale levels 0 and 2500.

After this, the operation returns to (1).

In order to avoid the endless loop described above, the deactivation grayscale level difference threshold value may be set to be small (e.g., 300 grayscale levels).

Figure 15:
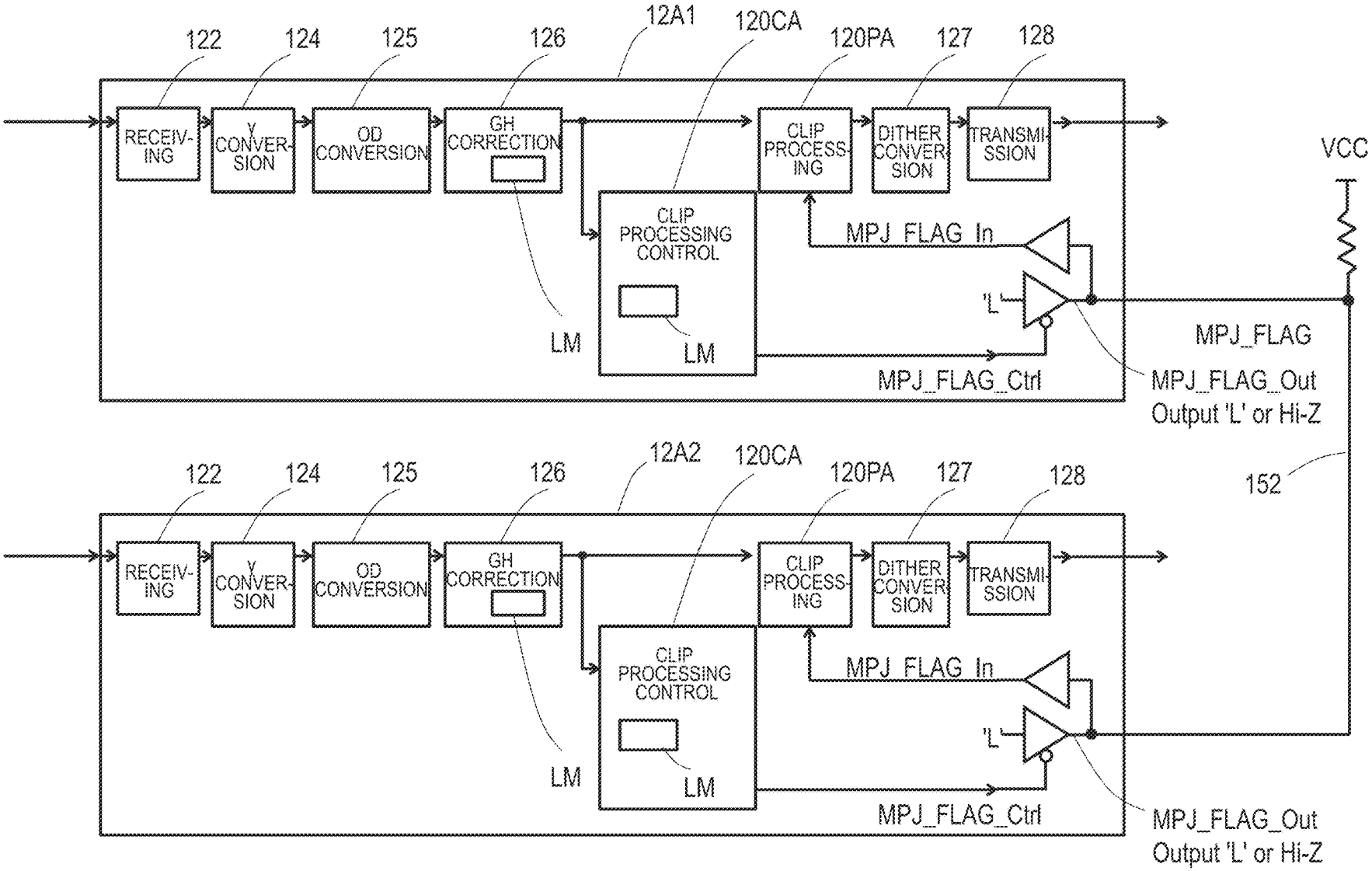
FIG. 15 is a schematic block diagram of a liquid crystal display apparatus including two display control circuits 12A1 and 12A2, and shows a form of connection between the display control circuit 12A1 and the display control circuit 12A2.

Now, FIG. 15 is a block diagram of a liquid crystal display apparatus including two display control circuits 12A1 and 12A2. FIG. 15 shows a connection state between the display control circuits 12A1 and 12A2. The display control circuits 12A1 and 12A2 may be used as the display control circuits 12_A and 12_B included in the liquid crystal display apparatus 100 shown in FIG. 1.

In the case where such a plurality of display control circuits 12A1 and 12A2 are included, the clip processing control circuit 120CA of each of the plurality of display control circuits 12A1 and 12A2 performs steps A through D described above on two or more pixel groups associated therewith. As a result, a plurality of clip processing control signals are generated. At this point, it is preferred that the clip processing circuit 120PA for each of the display control circuits 12A1 and 12A2 is configured to switch the clip processing to a state of being activated or to a state of being deactivated based on at least one of the plurality of clip processing control signals. The clip processing circuit 120PA is configured to, in the case where, for example, at least one of the plurality of clip processing control signals is a signal activating the clip processing or a signal maintaining the clip processing activated, switch the clip processing to a state of being activated or maintain the clip processing in the state of being activated.

As shown in, for example, FIG. 15, the display control circuits 12A1 and 12A2 each have substantially the same configuration as that of the display control circuit 12A shown in FIG. 5. The liquid crystal display apparatus further includes a signal line 152 connecting the display control circuits 12A1 and 12A2 to each other. The display control circuits 12A1 and 12A2 are configured to share the plurality of clip processing control signals via the signal line 152.

The signal line 152 connects the display control circuits 12A1 and 12A2 to each other by a system of open drain (Hi-Z or L) and pull-up. The display control circuits 12A1 and 12A2 each output Hi-Z to deactivate the clip processing, and output L to activate the clip processing. When the outputs of all the display control circuits 12A1 and 12A2 are Hi-Z, the signal line 152 is H. When at least one of the outputs from the display control circuits 12A1 and 12A2 is L, the signal line 152 is L. The signal line 152 acts as an input/output terminal of each of the display control circuits 12A1 and 12A2. Whether the clip processing is to be activated or deactivated is determined based on whether the signal line 152 is in the L state or the H state.

The display control circuits 12A1 and 12A2 shown in FIG. 15 follow, for example, the truth table shown in Table 11 below to control the state (L/H) of the signal line 152.

TABLE 11

| | | Case 1 | Case 2 | Case 3 | Case 4 |
|---|---|---|---|---|---|
| DISPLAY CONTROL CIRCUIT 12A1 | MPJ_FLAG_Ctrl | L | H | L | H |
| DISPLAY CONTROL CIRCUIT 12A2 | MPJ_FLAG_Ctrl | L | L | H | H |
| DISPLAY CONTROL CIRCUIT 12A1 | MPJ_FLAG_Out | L | Hi-Z | L | Hi-Z |
| DISPLAY CONTROL CIRCUIT 12A2 | MPJ_FLAG_Out | L | L | Hi-Z | Hi-Z |
| COMMON (INCLUDING PULL-UP) | MPJ_FLAG | L | L | L | H |
| DISPLAY CONTROL CIRCUIT 12A1 | MPJ_FLAG_In | L | L | L | H |
| DISPLAY CONTROL CIRCUIT 12A2 | MPJ_FLAG_In | L | L | L | H |

Adoption of the above-described configuration provides an advantage that as shown in FIG. 15, the plurality of display control circuits 12A1 and 12A2 may have the same circuit configuration. Herein, the circuits that perform the determination based on the grayscale level difference are shown. Needless to say, the above-described configuration is also applicable to circuits that perform the determination based on the grayscale voltage difference.

Figure 16:
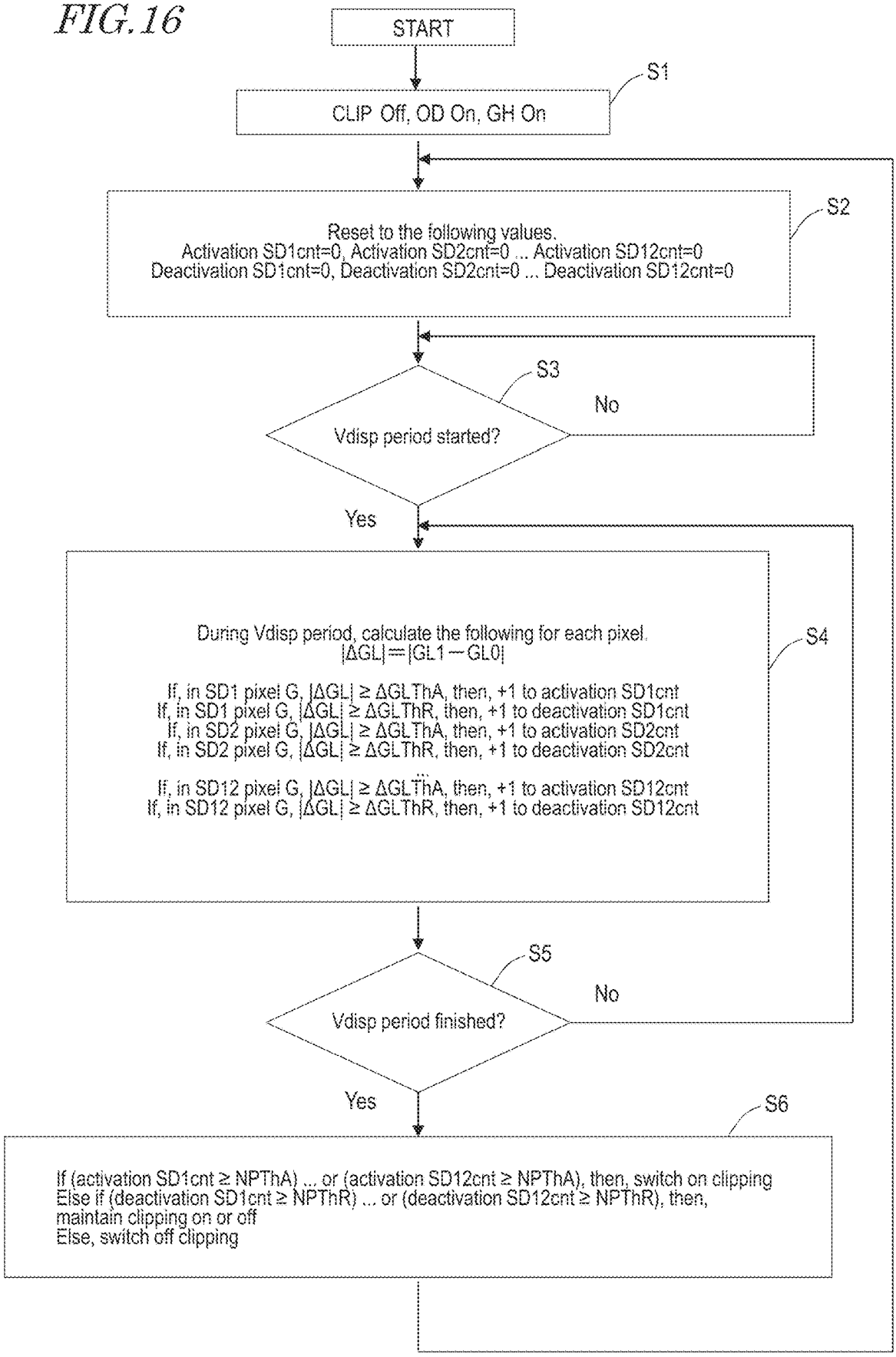
FIG. 16 is a flowchart showing an example of flow of clip processing control (determination is made after Vdisp is finished) in the liquid crystal display apparatus according to each of the first and second embodiments.
Figure 17:
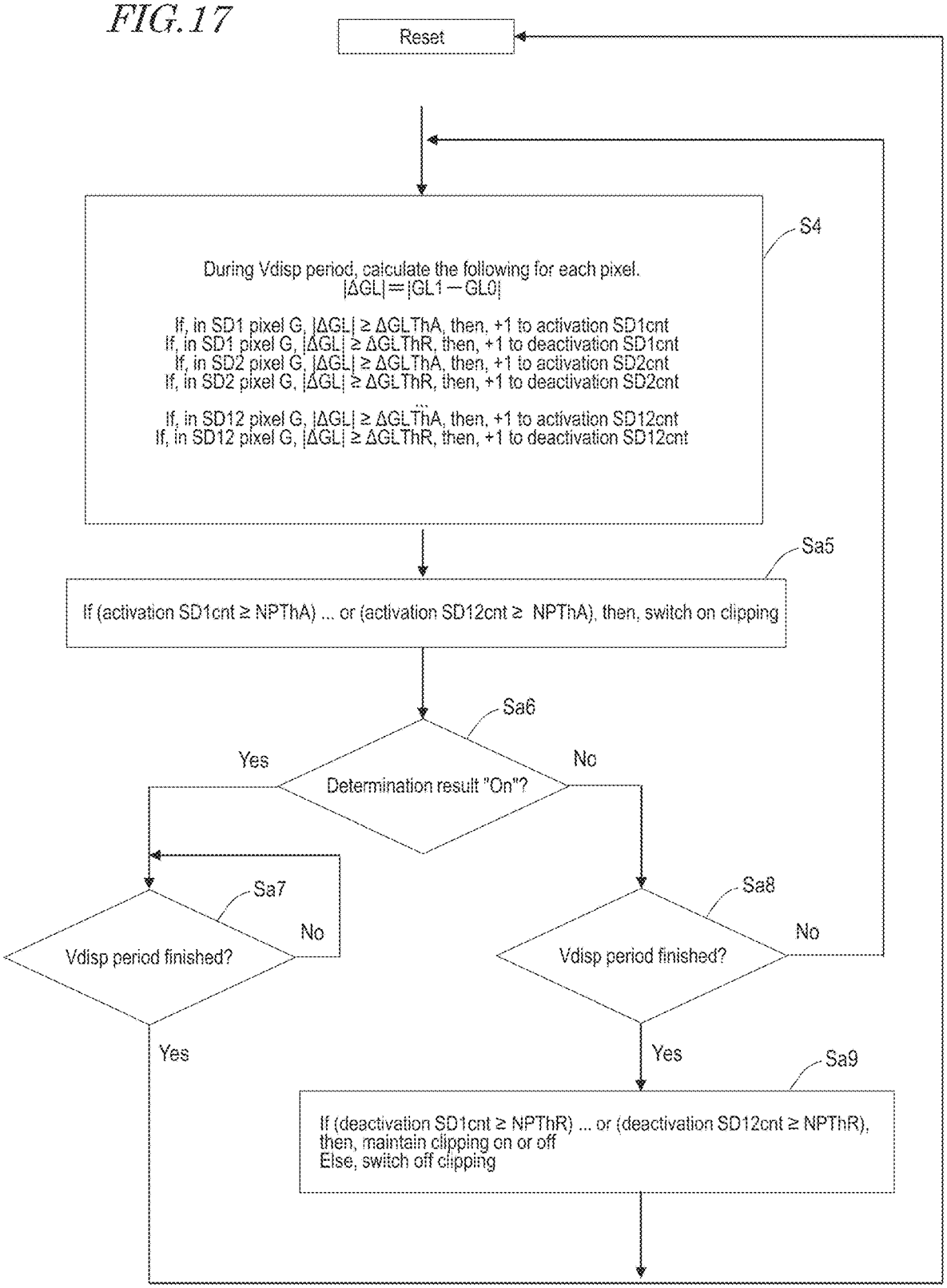
FIG. 17 is a flowchart showing another example of flow of clip processing control (determination is made each time) in the liquid crystal display apparatus according to each of the first and second embodiments.
Figure 18:
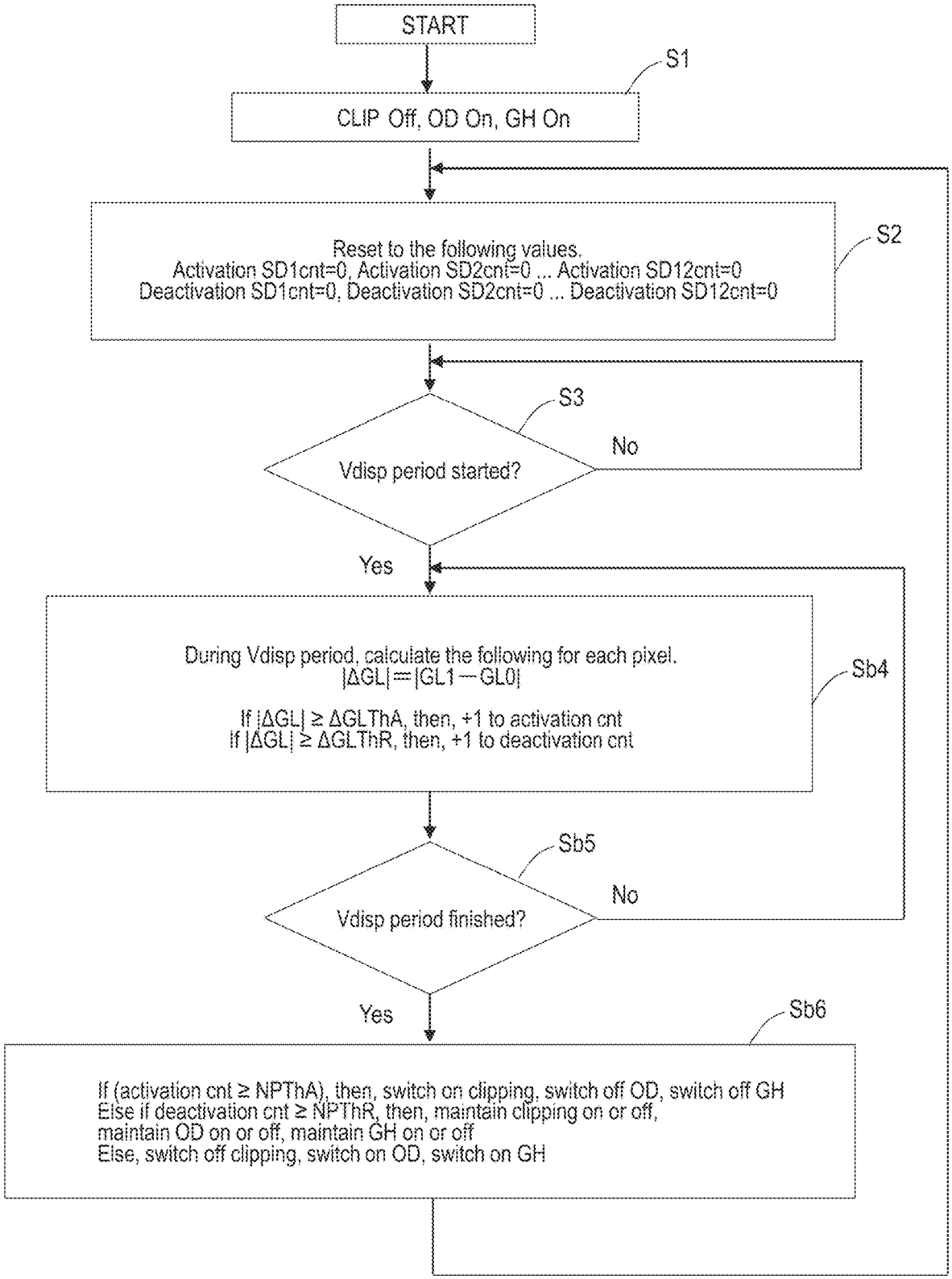
FIG. 18 is a flowchart showing an example of flow of clip processing control (determination is made after Vdisp is finished) in the liquid crystal display apparatus according to the third embodiment.

Now, FIG. 16 through FIG. 18 show an example of flow of clip processing control in a liquid crystal display apparatus according to an embodiment of the present invention.

FIG. 16 is a flowchart showing an example of flow of clip processing control in a liquid crystal display apparatus according to each of the first and second embodiments. Here, the liquid crystal display apparatus includes 12 source drivers SD (SD1 through SD12), and performs the determination step for each of the pixel groups respectively corresponding to the source drivers. In the figures, pixel groups respectively corresponding to the source drivers SD1 through SD12 are represented as SD1 pixel group G through SD12 pixel group G for the sake of simplicity. The determination on whether to activate or to deactivate the clip processing is performed after the effective display period (Vdisp) in each vertical scanning period is finished.

First, the clip processing is set to off, the OD conversion is set to on, and the GH correction is set to on as initial settings (step S1). Next, the values of the activation counter and the deactivation counter provided in correspondence with each pixel group are reset to 0 (step S2). Next, when the effective display period is determined to have started (step S3), |ΔGL| is calculated for each pixel in each pixel group, and is compared with the activation threshold value and the deactivation threshold value. In the case where |ΔGL| is larger than, or equal to, the activation threshold value, 1 is added to the value of the activation counter; and in the case where |ΔGL| is larger than, or equal to, the deactivation threshold value, 1 is added to the value of the deactivation counter (step S4). This step is performed until the effective display period is determined to have been finished (step S5). After the effective display period is finished, it is determined whether to activate the clip processing, to deactivate the clip processing or to maintain the clip processing activated or deactivated, based on the number of pixels having |ΔGL| larger than, or equal to, the activation threshold value and the number of pixels having |ΔGL| larger than, or equal to, the deactivation threshold value, both of which were found for each pixel group, and also based on the activation pixel number threshold value and the deactivation pixel number threshold value (step S6).

FIG. 17 is a flowchart showing another example of flow of clip processing control in a liquid crystal display apparatus according to each of the first and second embodiments. FIG. 17 shows step S4 and thereafter in FIG. 16. Here also, the liquid crystal display apparatus includes 12 source drivers SD (SD1 through SD12), and performs the determination step for each of the pixel groups SD1 pixel G through SD12 pixel G respectively corresponding to the source drivers SD1 through SD12. It should be noted that it is determined whether to activate or to deactivate the clip processing each time the counter is operated. Namely, in step S4, each time 1 is added (or is not added) to the activation counter and the deactivation counter for each pixel, the number of pixels having |ΔGL| larger than, or equal to, the activation threshold value (value of the counter) and the activation pixel number threshold value are compared with each other. In the case where the number of pixels having |ΔGL| larger than, or equal to, the activation threshold value is larger than, or equal to, the activation pixel number threshold value, it is determined to activate the clip processing (On), and the clip processing is activated (step Sa5). When the determination result is On in step Sa5 (step Sa6), the process waits until the effective display period is finished (step Sa7). By contrast, when the determination result is not On in step Sa5 (step Sa6), in the case where the effective display period has not been finished (step Sa8: No), the process returns to step S4. In the case where the effective display period has been finished (step Sa8: Yes), it is determined whether to maintain the clip processing activated or deactivated or to deactivate the clip processing, based on the number of pixels having |ΔGL| larger than, or equal to, the deactivation threshold value and also based on the deactivation pixel number threshold value (step Sa9).

FIG. 18 is a flowchart showing an example of flow of clip processing control in a liquid crystal display apparatus according to the third embodiment. The liquid crystal display apparatus includes one display control circuit, performs the determination step for each of the display control circuits, and determines whether to activate or to deactivate the clip processing after the effective display period in each vertical scanning period is finished. Steps S1 through S3 are the same as in the flow in each of FIG. 16 and FIG. 17. Instead of step S4, |ΔGL| is calculated for each of all the pixels, and is compared with the activation threshold value and the deactivation threshold value. In the case where |ΔGL| is larger than, or equal to, the activation threshold value, 1 is added to the value of the activation counter; and in the case where |ΔGL| is larger than, or equal to, the deactivation threshold value, 1 is added to the value of the deactivation counter (step Sb4). This step is performed until the effective display period is determined to have been finished (step Sb5). After the effective display period is finished, it is determined whether to activate the clip processing, to deactivate the clip processing or to maintain the clip processing activated or deactivated, based on the number of pixels having |ΔGL| larger than, or equal to, the activation threshold value and the number of pixels having MI larger than, or equal to, the deactivation threshold value, both of which were found for all the pixels, and also based on the activation pixel number threshold value and the deactivation pixel number threshold value (step Sb6).

In the liquid crystal display apparatus according to the third embodiment, the γ conversion circuit also acts as the clip processing circuit. Therefore, time is required to change the value of the LUT (to refer to a different LUT). For example, it is preferred to provide a preparation period of, for example, 1 to 5 vertical scanning periods in order to allow the value of the LUT to be read from an external ROM. The liquid crystal display apparatus according to each of the first and second embodiments includes a circuit specialized as the clip processing circuit, and therefore, may perform the clip processing in real time. However, in the case where the clip processing is switched on or off during the vertical scanning period (frame), an unnatural image at the transition of the switch is displayed. In order to prevent this, it is preferred to switch the clip processing to a state of being activated or to a state of being deactivated as follows. The current state of the clip processing of being activated or deactivated is maintained until a certain vertical scanning period after the current vertical scanning period is finished, and the clip processing is switched to a state of being activated or to a state of being deactivated at the start of the vertical scanning period next to the certain vertical scanning period. For example, the certain vertical scanning period may be the fourth vertical scanning period after the current vertical scanning period. Such an arrangement is preferably usable for the liquid crystal display apparatus according to the third embodiment.

An embodiment of the present invention provides a liquid crystal display apparatus capable of effectively decreasing the power consumption in order to suppress an increase in the temperature of components while suppressing a decrease in the display quality. According to an embodiment of the present invention, there is no need to take a measure against heat generation, for example, provision of a heat dissipation sheet. Therefore, an increase in the cost of the liquid crystal display apparatus may be suppressed. According to an embodiment of the present invention, strictly describing, the power consumption is not suppressed for a short period of time until the clipping processing is activated. However, the temperature of the components is not increased soon, and therefore, an effect of suppressing an increase in the temperature of the components may be provided.

While the present invention has been described with respect to exemplary embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A liquid crystal display apparatus, comprising:

a display panel; and one display control circuit or a plurality of display control circuits receiving an input video signal and causing the display panel to display an image, wherein the display panel includes a plurality of pixels, a plurality of TFTs, a plurality of gate bus lines, a plurality of source bus lines, a plurality of gate driving circuits supplying the plurality of gate bus lines with a gate signal, and a plurality of source driving circuits supplying the plurality of source bus lines with a source signal; and each of the plurality of pixels is connected to one of the plurality of source bus lines via a TFT corresponding thereto among the plurality of TFTs, and each of the plurality of TFTs is connected to one of the plurality of gate bus lines, wherein the plurality of source driving circuits are configured to supply each of the plurality of source bus lines with a source signal that does not have a polarity thereof changed during an effective display period included in one vertical scanning period and has the polarity thereof inverted between two continuous vertical scanning periods, wherein the plurality of pixels form a plurality of pixel groups respectively corresponding to the plurality of source driving circuits, and the pixels included in each of the plurality of pixel groups are each supplied with a source signal from a source driving circuit corresponding thereto among the plurality of source driving circuits via the corresponding source bus line, wherein the one display control circuit or each of the plurality of display control circuits controls display of two or more pixel groups associated therewith among the plurality of pixel groups, wherein the one display control circuit or each of the plurality of display control circuits generates a set of output grayscale data regarding each of the associated two or more pixel groups based on input grayscale data in the input video signal, wherein the one display control circuit or each of the plurality of display control circuits includes a clip processing control circuit generating a clip processing control signal and a clip processing circuit performing clip processing in accordance with the clip processing control signal, and wherein the clip processing control circuit is configured to be capable of performing, in each one vertical scanning period, in a process in which the one display control circuit or each of the plurality of display control circuits generates the set of output grayscale data, a determination step including:

step A of finding, regarding each of the pixels belonging to each of the associated two or more pixel groups, an absolute value $|\Delta GL|$ of a difference $\Delta GL$ between a grayscale level $GL_1$ in a current horizontal scanning period $HP_1$ and a grayscale level $GL_0$ in an immediately previous horizontal scanning period $HP_0$ immediately previous to the current horizontal scanning period $HP_1$ of first input grayscale data to be input to the clip processing control circuit, with the associated two or more pixel groups being a determination unit, or with at least one pixel group among the associated two or more pixel groups being the determination unit, step B1 of comparing $|\Delta GL|$ regarding each of the pixels belonging to the determination unit and a predetermined activation grayscale level difference threshold value $\Delta GLThA$ with each other, and finding a number $NP_1$ of first pixels fulfilling $|\Delta GL| \geq \Delta GLThA$ among the pixels belonging to the determination unit, step B2 of comparing $|\Delta GL|$ regarding each of the pixels belonging to the determination unit and a predetermined deactivation grayscale level difference threshold value $\Delta GLThR$ ($<\Delta GLThA$) with each other, and finding a number $NP_2$ of second pixels fulfilling $|\Delta GL| \geq \Delta GLThR$ among the pixels belonging to the determination unit, step C1 of comparing the number $NP_1$ of the first pixels and a predetermined activation pixel number threshold value NPThA with each other, and determining whether or not $NP_1 \geq NPThA$ is fulfilled, and step C2 of comparing the number $NP_2$ of the second pixels and a predetermined deactivation pixel number threshold value NPThR (<NPThA) with each other, and determining whether or not $NP_2 \geq NPThR$ is fulfilled, and step D of generating, based on the results of steps C1 and C2, the clip processing control signal that activates the clip processing of limiting a grayscale level of the first input grayscale data to a predetermined range, deactivates the clip processing, or maintains the clip processing activated or deactivated, regarding each of the pixels belonging to each of the associated two or more pixel groups.

2. The liquid crystal display apparatus of claim 1, wherein the determination step is executed with each pixel group among the associated two or more pixel groups being the determination unit, and wherein in step D, the clip processing control circuit generates the clip processing control signal that activates the clip processing in the case where the result of step C1 is true regarding at least one pixel group among the associated two or more pixel groups, maintains the clip processing activated or deactivated in the case where the result of step C1 is false regarding all the associated two or more pixel groups and the result of step C2 is true regarding at least one pixel group among the associated two or more pixel groups, and deactivates the clip processing in the case where the result of C2 is false regarding all the associated two or more pixel groups.

3. The liquid crystal display apparatus of claim 1, wherein the determination step is executed with the associated two or more pixel groups being the determination unit, and wherein in step D, the clip processing control circuit generates the clip processing control signal that activates the clip processing in the case where the result of step C1 is true, maintains the clip processing activated or deactivated in the case where the result of step C1 is false and the result of step C2 is true, and deactivates the clip processing in the case where the result of C2 is false.

4. The liquid crystal display apparatus of claim 1, wherein the one display control circuit or the plurality of display control circuits is one display control circuit, and wherein the associated two or more pixel groups are the plurality of pixel groups.

5. The liquid crystal display apparatus of claim 1, wherein the one display control circuit or the plurality of display control circuits is the plurality of display control circuits, and wherein the clip processing control circuit in each of the plurality of display control circuits performs steps A through D regarding the two or more pixel groups associated therewith, and as a result, a plurality of the clip processing control signals are generated, and wherein the clip processing circuit in each of the plurality of display control circuits switches the clip processing to a state of being activated or to a state of being deactivated based on at least one of the plurality of clip processing control signals.

6. The liquid crystal display apparatus of claim 5, wherein the clip processing circuit in each of the plurality of display control circuits switches the clip processing to a state of being activated or maintains the clip processing in the state of being activated in the case where the at least one of the plurality of clip processing control signals is a signal that activates the clip processing or a signal that maintains the clip processing activated.

7. The liquid crystal display apparatus of claim 5, further comprising a signal line connecting the plurality of display control circuits to each other, wherein the plurality of display control circuits share the plurality of clip processing control signals via the signal line.

8. The liquid crystal display apparatus of claim 1, wherein steps A, B1 and B2 are performed during the effective display period included in one vertical scanning period, and wherein steps C1, C2 and D are performed after steps B1 and B2 are finished but before the one vertical scanning period is finished.

9. The liquid crystal display apparatus of claim 1, wherein the clip processing limits a lower limit and/or an upper limit of the grayscale level of the first input grayscale data.

10. The liquid crystal display apparatus of claim 1, wherein for switching the clip processing to a state of being activated or to a state of being deactivated, the clip processing circuit maintains the current state of the clip processing of being activated or deactivated until a certain vertical scanning period after a current vertical scanning period is finished, and switches the clip processing to the state of being activated or to the state of being deactivated at the start of a vertical scanning period next to the certain vertical scanning period.

11. The liquid crystal display apparatus of claim 10, wherein the certain vertical scanning period is a fourth vertical scanning period after the current vertical scanning period.

12. The liquid crystal display apparatus of claim 1, wherein the clip processing circuit is located on a stage after the clip processing control circuit.

13. The liquid crystal display apparatus of claim 1, wherein the one display control circuit or each of the plurality of display control circuits further includes an overdrive conversion circuit, wherein the first input grayscale data is overdrive-converted by the overdrive conversion circuit, and wherein the overdrive conversion circuit does not perform overdrive conversion while the clip processing is activated, and performs the overdrive conversion while the clip processing is deactivated.

14. The liquid crystal display apparatus of claim 1, wherein the one display control circuit or each of the plurality of display control circuits further includes a ghost correction circuit, wherein the ghost correction circuit performs ghost correction on the first input grayscale data, and wherein the ghost correction circuit shares a line memory with the clip processing control circuit.

15. The liquid crystal display apparatus of claim 1, wherein the one display control circuit or each of the plurality of display control circuits further includes a dither conversion circuit, and wherein the set of output grayscale data is generated as a result of the first input grayscale data processed by the clip processing being dither-converted by the dither conversion circuit.

16. A liquid crystal display apparatus, comprising:

a display panel; and one display control circuit or a plurality of display control circuits receiving an input video signal and causing the display panel to display an image, wherein the display panel includes a plurality of pixels, a plurality of TFTs, a plurality of gate bus lines, a plurality of source bus lines, a plurality of gate driving circuits supplying the plurality of gate bus lines with a gate signal, and a plurality of source driving circuits supplying the plurality of source bus lines with a source signal; and each of the plurality of pixels is connected to one of the plurality of source bus lines via a TFT corresponding thereto among the plurality of TFTs, and each of the plurality of TFTs is connected to one of the plurality of gate bus lines, wherein the plurality of source driving circuits are configured to supply each of the plurality of source bus lines with a source signal that does not have a polarity thereof changed during an effective display period included in one vertical scanning period and has the polarity thereof inverted between two continuous vertical scanning periods, wherein the plurality of pixels form a plurality of pixel groups respectively corresponding to the plurality of source driving circuits, and the pixels included in each of the plurality of pixel groups are each supplied with a source signal from a source driving circuit corresponding thereto among the plurality of source driving circuits via the corresponding source bus line, wherein the one display control circuit or each of the plurality of display control circuits controls display of two or more pixel groups associated therewith among the plurality of pixel groups, wherein the one display control circuit or each of the plurality of display control circuits generates a set of output grayscale data regarding each of the associated two or more pixel groups based on input grayscale data in the input video signal, wherein the one display control circuit or each of the plurality of display control circuits includes a clip processing control circuit generating a clip processing control signal and a clip processing circuit performing clip processing in accordance with the clip processing control signal, wherein the clip processing control circuit includes a grayscale-voltage conversion circuit converting grayscale data into grayscale voltage data, and wherein the clip processing control circuit is configured to be capable of performing, in each one vertical scanning period, in a process in which the one display control circuit or each of the plurality of display control circuits generates the set of output grayscale data, a determination step including:

step A of finding, regarding each of the pixels belonging to each of the associated two or more pixel groups, an absolute value $|\Delta VG|$ of a difference $\Delta VG$ between a grayscale voltage $VG_1$ in a current horizontal scanning period $HP_1$ and a grayscale voltage $VG_0$ in an immediately previous horizontal scanning period $HP_0$ immediately previous to the current horizontal scanning period $HP_1$ of first input grayscale voltage data converted from the first input grayscale data to be input to the clip processing control circuit, with the associated two or more pixel groups being a determination unit, or with at least one pixel group among the associated two or more pixel groups being the determination unit, step B1 of comparing $|\Delta VG|$ regarding each of the pixels belonging to the determination unit and a predetermined activation grayscale voltage difference threshold value $\Delta VGThA$ with each other, and finding a number $NP_1$ of first pixels fulfilling $|\Delta VG| \geq \Delta VGThA$ among the pixels belonging to the determination unit, step B2 of comparing $|\Delta VG|$ regarding each of the pixels belonging to the determination unit and a predetermined deactivation grayscale voltage difference threshold value $\Delta VGThR$ ($<\Delta VGThA$) with each other, and finding a number $NP_2$ of second pixels fulfilling $|\Delta VG| \geq \Delta VGThR$ among the pixels belonging to the determination unit, step C1 of comparing the number $NP_1$ of the first pixels and a predetermined activation pixel number threshold value NPThA with each other, and determining whether or not $NP_1 \geq NPThA$ is fulfilled, and step C2 of comparing the number $NP_2$ of the second pixels and a predetermined deactivation pixel number threshold value NPThR (<NPThA) with each other, and determining whether or not $NP_2 \geq NPThR$ is fulfilled, and step D of generating, based on the results of steps C1 and C2, the clip processing control signal that activates the clip processing of limiting a grayscale level of the first input grayscale data to a predetermined range, deactivates the clip processing, or maintains the clip processing activated or deactivated, regarding each of the pixels belonging to each of the associated two or more pixel groups.

* * * * *